US007769315B2

(12) United States Patent
Tanaka

(10) Patent No.: US 7,769,315 B2
(45) Date of Patent: Aug. 3, 2010

(54) CLEANING DEVICE, CHARGER UNIT USING THE SAME, IMAGE FORMING ASSEMBLY AND IMAGE FORMING APPARATUS

(75) Inventor: Arichika Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 36 days.

(21) Appl. No.: 12/337,120

(22) Filed: Dec. 17, 2008

(65) Prior Publication Data

US 2009/0304410 A1 Dec. 10, 2009

(30) Foreign Application Priority Data

Jun. 10, 2008 (JP) ..... P2008-151889

(51) Int. Cl.
*G03G 15/02* (2006.01)

(52) U.S. Cl. ..... 399/100

(58) Field of Classification Search ..... 399/100, 399/170–173

See application file for complete search history.

(56) References Cited

U.S. PATENT DOCUMENTS 4,956,671 A * 9/1990 Otsuka ..... 399/100
2008/0199207 A1* 8/2008 Takayama ..... 399/100

FOREIGN PATENT DOCUMENTS

| | | | |
|---|---|---|---|
| JP | 06-043735 | * | 7/1992 |
| JP | 08-305135 | | 11/1996 |
| JP | 2004-109721 | | 4/2004 |
| JP | 2005-107236 | | 4/2005 |

* cited by examiner

*Primary Examiner*—Hoang Ngo
(74) *Attorney, Agent, or Firm*—Morgan, Lewis & Bockius LLP

(57) ABSTRACT

A cleaning device includes a pair of bilateral cleaning members arranged with an interval in a length direction of a wire rod, an intermediate cleaning member located on an opposite side of the pair of bilateral cleaning members via the wire rod and arranged at an intermediate position between the bilateral cleaning members in the length direction of the wire rod, a wire rod contact unit that controls at least one of the plurality of cleaning members so that the plurality of cleaning members contacts with or separates away from the wire rod, and a cleaning movement unit which moves the plurality of cleaning members along the length direction of the wire rod in the state where the plurality of cleaning members are in contact with the wire rod by the wire rod contact unit.

13 Claims, 38 Drawing Sheets

OUTWARD PATH

RETURN PATH

OUTWARD PATH
211
202
θ1
OPERATION DIRECTION OF WIRE ROD
F
-Fx
Fy

RETURN PATH
θ2
-Fy
Fx

FIG. 37

| DISCHARGE WIRE DIAMETER (μm) | CLEANING PAD BITE AMOUNT (mm) | CLEANING PAD CUT (NO CUT: ○ CUT: ×) | | | | | | |
|---|---|---|---|---|---|---|---|---|
| | | CLEANING NUMBER | | | | | | |
| | | 90 | 180 | 360 | 540 | 720 | 900 | 1080 |
| φ30 TWO CLEANING PADS | 0.4 | ○ | ○ | ○ | ○ | ○ | ○ | ○ |
| | 0.7 | ○ | ○ | ○ | ○ | ○ | ○ | ○ |
| | 1 | ○ | ○ | ○ | ○ | ○ | ○ | ○ |
| | 1.3 | ○ | ○ | ○ | × | — | — | — |
| | 1.6 | ○ | × | — | — | — | — | — |
| | 1.8 | × | — | — | — | — | — | — |
| φ40 TWO CLEANING PADS | 0.4 | ○ | ○ | ○ | ○ | ○ | ○ | ○ |
| | 0.7 | ○ | ○ | ○ | ○ | ○ | ○ | ○ |
| | 1 | ○ | ○ | ○ | ○ | ○ | ○ | ○ |
| | 1.3 | ○ | ○ | ○ | ○ | ○ | ○ | ○ |
| | 1.6 | ○ | ○ | ○ | ○ | ○ | × | × |
| | 1.8 | ○ | ○ | ○ | ○ | × | — | — |

CLEANING DEVICE, CHARGER UNIT USING THE SAME, IMAGE FORMING ASSEMBLY AND IMAGE FORMING APPARATUS

CROSS-REFERENCE TO RELATED APPLICATION

This application is based on and claims priority under 35 USC 119 form Japanese Patent Application No. 2008-151889 filed Jun. 10, 2008.

BACKGROUND

Technical Field

The present invention relates to a cleaning device, a charger using the cleaning device, an image forming assembly and an image forming apparatus.

SUMMARY

According to an aspect of the invention, a cleaning device includes a pair of bilateral cleaning members arranged with an interval in a length direction of a wire rod, an intermediate cleaning member located on an opposite side of the pair of bilateral cleaning members via the wire rod and arranged at an intermediate position between the bilateral cleaning members in the length direction of the wire rod, a wire rod contact unit that controls at least one of the plurality of cleaning members so that the plurality of cleaning members contacts with or separates away from the wire rod, and a cleaning movement unit which moves the plurality of cleaning members along the length direction of the wire rod in the state where the plurality of cleaning members are in contact with the wire rod by the wire rod contact unit. A is a first interval along the length direction of the wire rod between the bilateral cleaning member located on a forward side of a movement direction and the intermediate cleaning member. B is a second interval along the length direction of the wire rod between the bilateral cleaning member located on the backward side in the movement direction and the intermediate cleaning member. A<B is satisfied when the pair of bilateral cleaning members and the intermediate cleaning member are moved with being into contact with the wire rod.

BRIEF DESCRIPTION OF THE DRAWINGS

Exemplary embodiments of the invention will be described in detail based on the following figures, wherein:

FIG. 37 is an explanatory view showing the results of investigating the durability of the cleaning pad for the diameter of discharge wire in a comparative example 5.

DETAILED DESCRIPTION

First of all, the exemplary embodiments of the present invention will be outlined below.

Outline of Exemplary Embodiments

Figure 1A:
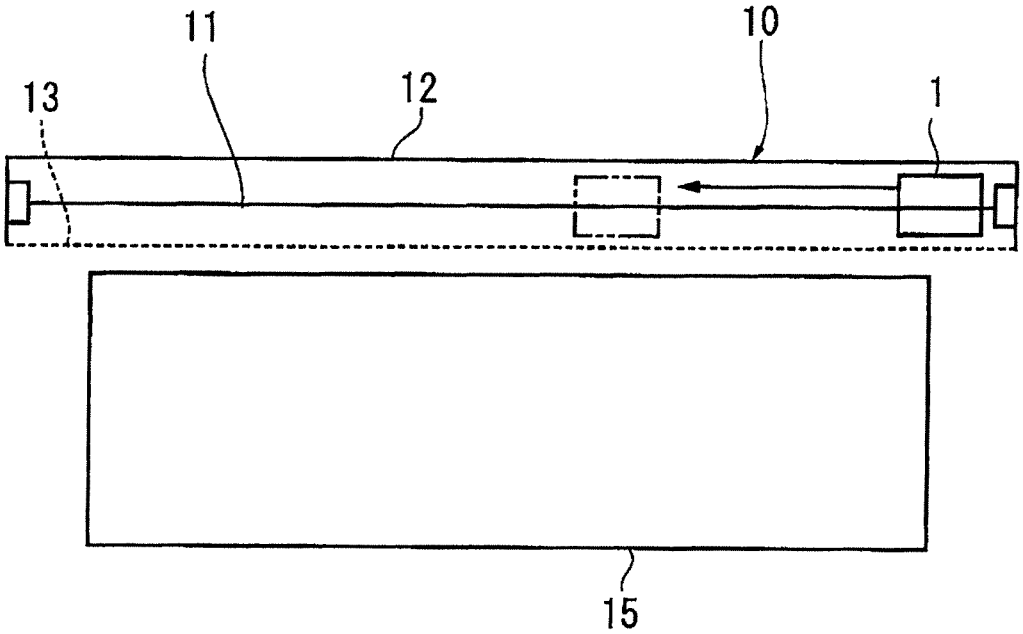
FIG. 1A is an explanatory view typically showing the outline of an image forming apparatus according to an exemplary embodiment of the present invention.
Figure 1B:
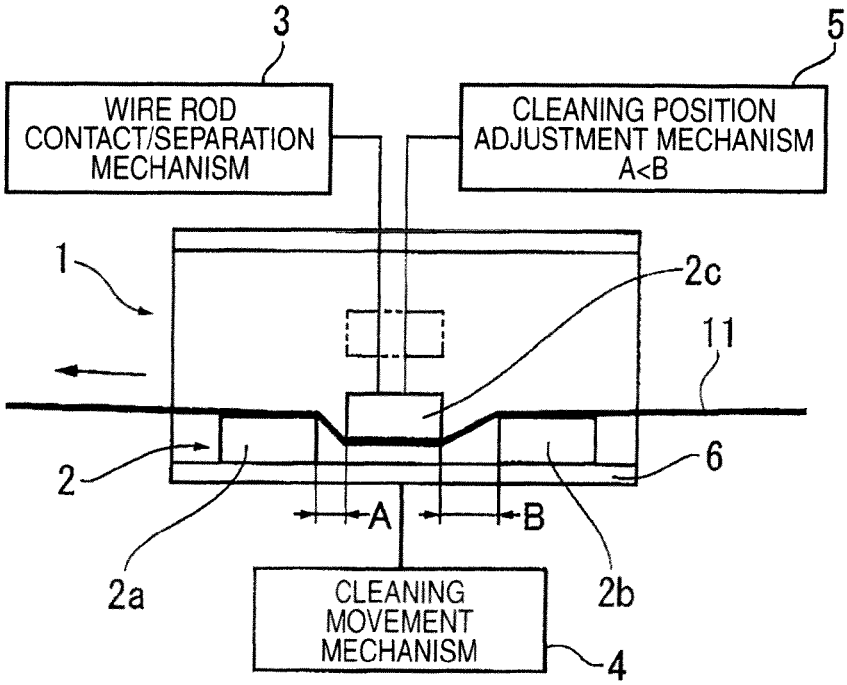
FIG. 1B is an explanatory view typically showing a representative model of its cleaning device.

FIGS. 1A and 1B are explanatory views showing the outline of an image forming apparatus according to an exemplary embodiment of the invention.

In FIG. 1, the image forming apparatus includes an image carrier 15 for bearing an image in which a latent image is visualized with an image creation material and a charger 10 for charging an image carrier 15.

And the image carrier 15 may be a photoconductor or dielectric in the form like a drum or belt, and one or more image carriers are provided depending on the creation image (monochrome image or multicolor image) of the image forming apparatus.

Also, the charger 10 includes a charging housing 12 opened opposed to the image carrier 15, a charging wire rod 11 disposed within this charging housing 12, and a cleaning device 1 for cleaning this charging wire rod 11.

Herein, the charger 10 may be provided with a lattice electrode 13 in an opening portion of the charging housing 12 to keep the uniformity of the charging property more excellent.

In the image forming apparatus of this type, the charger 10 may be removable from a main body of the image forming apparatus, or configured as an image forming assembly (e.g., a process cartridge) that may be mounted or demounted on or from the main body of the image forming apparatus together with the image carrier 15 or other devices (e.g., cleaning device for the image carrier 15), for example.

Further, in the exemplary embodiment, the cleaning device 1 includes:

one pair of bilateral cleaning members 2 (specifically 2*a*, 2*b*) arranged with a predetermined interval in the length direction of the charging wire rod 11;

an intermediate cleaning member 2 (specifically 2*c*) located on the opposite side of the one pair of bilateral cleaning members 2*a* and 2*b* via the charging wire rod 11 and arranged at an intermediate position between the bilateral cleaning members 2*a* and 2*b* in the length direction of the charging wire rod 11;

a wire rod contact/separation mechanism 3, which may move at least any one of the cleaning members 2 (2*a* to 2*c*), for contacting or separating the one pair of bilateral cleaning members 2*a* and 2*b* and the intermediate cleaning member 2*c* with or away from the charging wire rod 11; and a cleaning movement mechanism 4 for moving the one pair of bilateral cleaning members 2*a* and 2*b* and the intermediate cleaning member 2*c* along the length direction of the charging wire rod 11 in a state where the one pair of bilateral cleaning members 2*a* and 2*b* and the intermediate cleaning member 2*c* are in contact with the charging wire rod 11 by the wire rod contact/separation mechanism.

The interval between the bilateral cleaning member 2*a* or 2*b* located in the movement direction and the intermediate cleaning member 2*c* along the length direction of the charging wire rod 11 is A and the interval between the bilateral cleaning member 2*b* or 2*a* located on the opposite side in the movement direction and the intermediate cleaning member 2*c* along the length direction of the charging wire rod 11 is B. A<B is satisfied when all the cleaning members 2 are brought into contact with the charging wire rod 11, as particularly shown in FIG. 1B.

In such technical means, it is requisite that the cleaning member 2 has one pair of bilateral cleaning members 2*a* and 2*b* and one intermediate cleaning member 2*c*, but is not limited to the above form, in which other forms including an additional cleaning member may be also possible if they include at least three members in the above relationship. For example, another cleaning member may be provided on the same side as the intermediate cleaning member 2*c* and outside the bilateral cleaning members 2*a* and 2*b* in the length direction of the charging wire rod 11.

Also, the wire rod contact/separation mechanism 3 may move at least one of the cleaning members 2*a* to 2*c*, though it is required to contact or separate one pair of bilateral cleaning members 2*a* and 2*b* and the intermediate cleaning member 2*c* with or away from the charging wire rod 11.

Further, the cleaning movement mechanism 4 may move the cleaning member 2 placed in contact with the charging wire rod 11 by the wire rod contact/separation mechanism 3 along the length direction of the charging wire rod 11, in which the amount of movement or the movement direction may be appropriately selected.

For example, the cleaning member 2 may be brought into contact with the charging wire rod 11 in only one direction, and brought out of contact with the charging wire rod 11 and returned in the opposite direction, or of course, the cleaning member 2 may be reciprocated in a state where the cleaning member 2 is in contact with the charging wire rod 11.

Furthermore, for the intervals A and B between one pair of bilateral cleaning members 2*a* and 2*b* and the intermediate cleaning member 2*c* along the length direction of the charging wire rod 11, it is required that A<B is satisfied, when each of the cleaning members 2*a* to 2*c* is brought into contact with the charging wire rod 11.

Herein, for example, if the cleaning direction is one fixed direction, the interval between the cleaning members 2*a* to 2*c* may be uniquely set, and only when the cleaning members 2*a* to 2*c* are moved along the prescribed cleaning direction, they may contact the charging wire rod 11 to be moved in contact, so that A<B is satisfied. In this case, when the cleaning members 2*a* to 2*c* are returned in the opposite direction to the cleaning direction, the cleaning member 2*a* to 2*c* may be separated away from the charging wire rod 11 to be moved out of contact.

Also, if the cleaning direction is both ways of reciprocation, the interval between the cleaning members 2*a* to 2*c* may be changed depending on the movement direction of each cleaning member 2*a* to 2*c*.

In this form, the cleaning device may further include a cleaning position adjustment mechanism 5 for adjusting the positional relationship between the cleaning members 2*a* to 2*c* so that A<B may be satisfied when each cleaning member 2*a* to 2*c* is brought into contact with the charging wire rod 11.

In such cleaning device 1, a representative form of the cleaning member 2 may have an elastic base material with a nonwoven fabric on the surface of the elastic base material on the cleaning side, in which an abrasive having a polishing function may be provided on the surface of the non-woven fabric (including widely, such as in the form of a layer or the coating of power particle).

Also, to simplify the constitution of the cleaning device 1, the bilateral cleaning members 2*a* and 2*b* and the intermediate cleaning member 2*c* may have the common constitution.

Further, in a preferred form of the cleaning movement mechanism 4, from the viewpoint of keeping the cleaning performance of the cleaning member 2 more excellent, the cleaning member is reciprocated along the length direction of the charging wire rod 11 in a state where the cleaning members 2 (2*a* to 2*c*) are in contact with the charging wire rod 11 by the wire rod contact/separation mechanism 3 (reciprocating movement cleaning type).

In this case, when the movement direction of the cleaning members 2 is changed, the cleaning members may be kept contact with the charging wire rod 11, but from the viewpoint of suppressing a damage of the cleaning members 2 as much as possible, when the movement direction of the cleaning members 2 is changed, the cleaning members 2 may be brought into contact with the charging wire rod 11 again, after the cleaning members 2 are temporarily separated away from the charging wire rod 11.

In a representative form of the cleaning position adjustment mechanism 5 of the reciprocating movement cleaning type, the intervals between the adjacent cleaning members 2 along the length direction of the charging wire rod 11 may be changed depending on the movement direction of the cleaning member 2 along the length direction of the charging wire rod 11.

In the reciprocating movement cleaning type, if the movement direction of the cleaning member 2 is reversed, it is required that the intervals between the adjacent cleaning members 2 along the length direction of the charging wire rod 11 are reversed in the larger or smaller relationship to satisfy A<B.

Herein, to change the interval between the cleaning members 2, the intermediate cleaning member 2*c* or any of the bilateral cleaning members 2*a* and 2*b* may be moved along the length direction of the charging wire rod 11 to change the relative positional relationship between the intermediate cleaning member 2*c* and the bilateral cleaning members 2*a* and 2*b*.

Also, in a preferred form of the cleaning position adjustment mechanism 5 of the reciprocating movement cleaning type, the interval between the adjacent cleaning members 2 along the length direction of the charging wire rod 11 may be changed by moving the intermediate cleaning member 2*c* along the length direction of the charging wire rod 11 depending on the movement direction of the cleaning member 2 along the length direction of the charging wire rod 11.

Further, in a preferred form of the interval change timing of the cleaning position adjustment mechanism 5, from the viewpoint of preventing the cleaning members 2 from being worn away unnecessarily, the interval between the adjacent cleaning members 2 along the length direction of the charging wire rod 11 may be changed in a state where all the cleaning members 2 are separated away from the charging wire rod 11 by the wire rod contact/separation mechanism 3.

Furthermore, in a representative form of the movement type of the intermediate cleaning member 2*c* in the cleaning position adjustment mechanism 5 of the reciprocating movement cleaning type, the wire rod contact/separation mechanism 3 has a swing member configured such that the intermediate cleaning member 2*c* is swung around a swing fulcrum to contact or separate the intermediate cleaning member 2*c* with or away from the charging wire rod 11 the swing fulcrum being freely movable along the length direction of the charging wire rod 11, and the cleaning position adjustment mechanism 5 changes the position of the swing fulcrum of the swing member to change the relative position of the intermediate cleaning member 2*c* with the bilateral cleaning members 2*a* and 2*b*.

In this form, a long hole may be provided in a bearing portion of the swing fulcrum to enable the position of the swing fulcrum of the swing member that is a component of the wire rod contact separation mechanism 3 to be moved along the length direction of the charging wire rod 11, in which the movement range of the suing fulcrum is regulated in this long hole.

Also, as the cleaning member 2 of the charger 10, from the viewpoint of keeping the charging performance of the charger 10 excellent, any of the cleaning members 2 may clean the charging wire rod 11 on the side of the image carrier 15 as the charged body.

Further, in a form in which the charger 10 is arranged above the image carrier 15 as the charged body, from the viewpoint of effectively preventing the cleaning device 1 from being contaminated with cleaned matter, the cleaning movement mechanism 4 of the cleaning device 1 may include a cleaning receiving member provided under the bilateral cleaning members 2*a* and 2*b* and the intermediate cleaning member 2*c* to cover them, and movable together with all the cleaning members 2.

Furthermore, as the cleaning device 1 of the charger 10, from the viewpoint of keeping the charging performance of the charger 10 excellent, it is preferred to have a cleaning wait room in which the cleaning device 1 may wait at closer to an end portion in the longitudinal direction of the charging wire rod 11 out of the chargeable area of the charger 12 at the time of non-cleaning, in which the cleaning device 1 is moved from the cleaning wait room at the time of cleaning.

Next, the basic performance of the cleaning device (including three cleaning members 2*a* to 2*c*) for use in the exemplary embodiment as shown in FIG. 1 will be examined below.

Figure 2A:
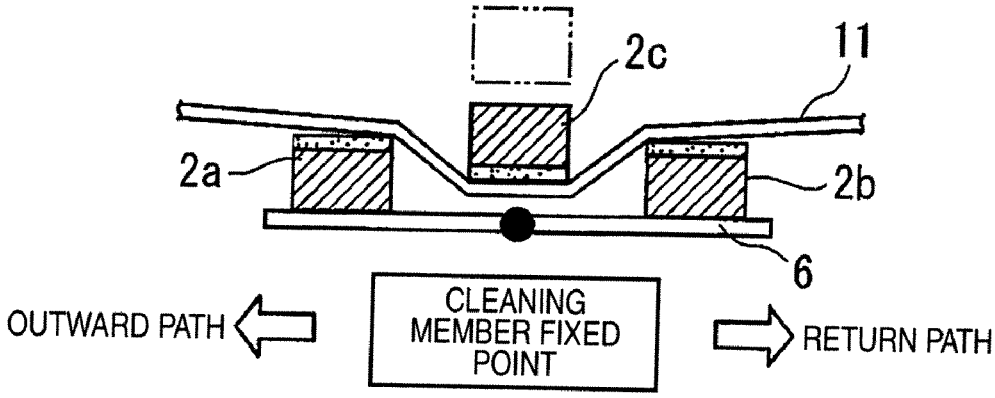
FIG. 2A is an explanatory view showing the outline of the behavior of the cleaning device for use in the exemplary embodiment as shown in FIG. 1.

Now, in the form as shown in FIG. 2A, for example, it is supposed that the intermediate cleaning member 2*c* is moved by the wire rod contact/separation mechanism 3 (see FIG. 1), the bilateral cleaning members 2*a* and 2*b* are fixed and arranged in the support member 6, and the bilateral cleaning members 2*a* and 2*b* and the intermediate cleaning member 2*c* are contacted with or separated away from the charging wire rod 11, and moved in the outward direction or the return direction as indicated by the arrow in a state where all the cleaning members 2 (2*a* to 2*c*) are in contact with the charging wire rod 11.

Figure 2B:
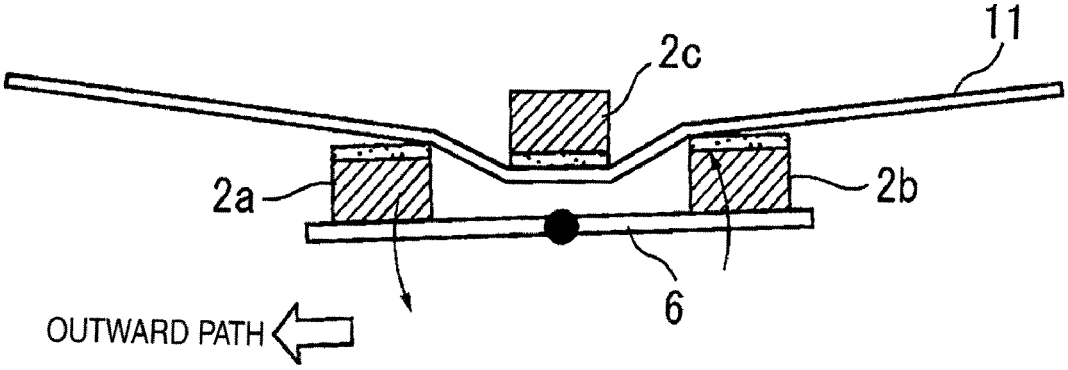
FIG. 2B is an explanatory view showing the outline of the behavior of the cleaning device during movement in the outward path.
Figure 3A:
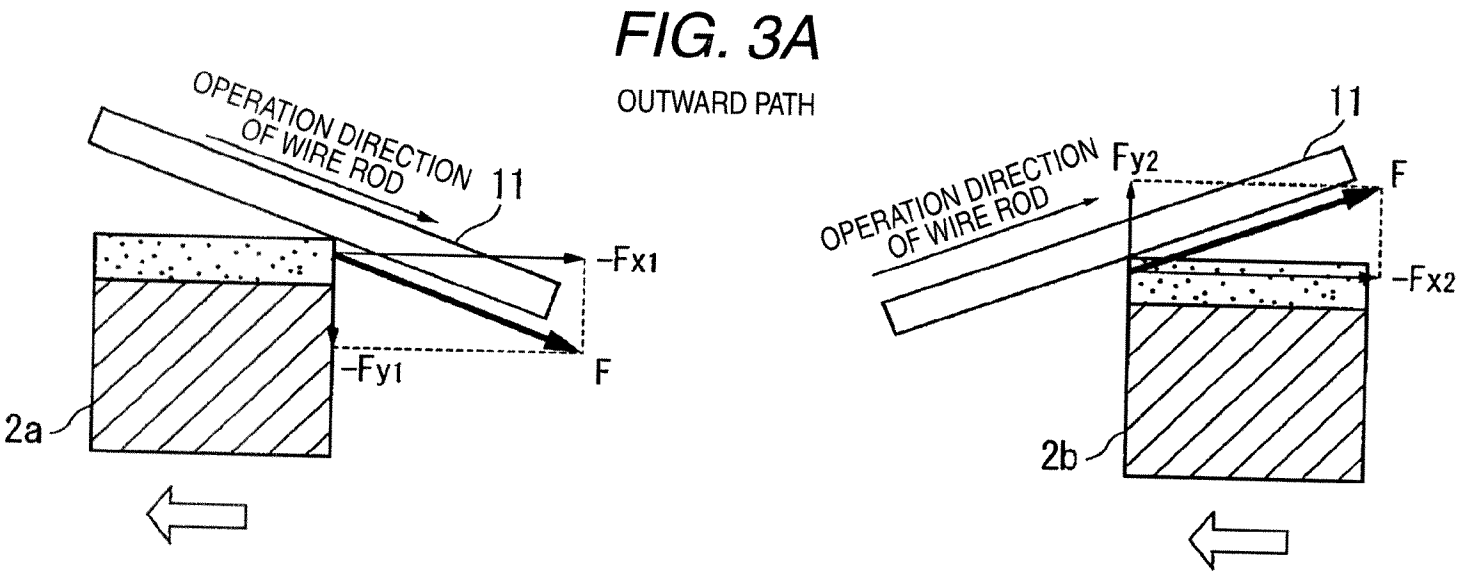
FIG. 3A is an explanatory view showing a force acting on the bilateral cleaning member in FIG. 2B.

Herein, if all the cleaning members 2 (2*a* to 2*c*) are moved in the outward direction as indicated by the arrow as shown in FIG. 2B, in the bilateral cleaning member 2*a* located in the outward direction across the intermediate cleaning member 2*c*, the charging wire rod 11 is relatively moved along with the movement of the bilateral cleaning member 2*a*, in which an action force F (−Fx1, −Fy1) acts on the bilateral cleaning member 2*a* in the operation direction of the charging wire rod 11 from the bilateral cleaning member 2*a* to the intermediate cleaning member 2*c*, so that the bilateral cleaning member 2*a* is inclined in the direction away from the charging wire rod 11 around a fixed point of the cleaning member that is the central fixed point of the support member 6, as shown in FIG. 3A.

On the other hand, in the bilateral cleaning member 2*b* located on the opposite side in the outward direction across the intermediate cleaning member 2*c*, the charging wire rod 11 is relatively moved along with the movement of the bilateral cleaning member 2*b*, in which an action force F (−Fx2, Fy2) acts on the bilateral cleaning member 2*b* in the operation direction of the charging wire rod 11 from the intermediate cleaning member 2*c* to the bilateral cleaning member 2*b*, so that the bilateral cleaning member 2*b* is inclined in the direction pushing against the charging wire rod 11 around the fixed point of the cleaning member that is the central fixed point of the support member 6, as shown in FIG. 3A.

Figure 2C:
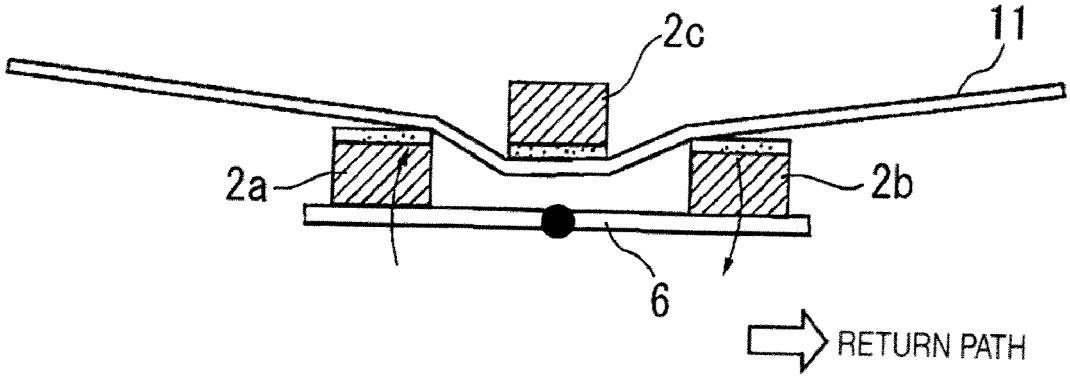
FIG. 2C is an explanatory view showing the outline of the behavior of the cleaning device during its movement in the return path.
Figure 3B:
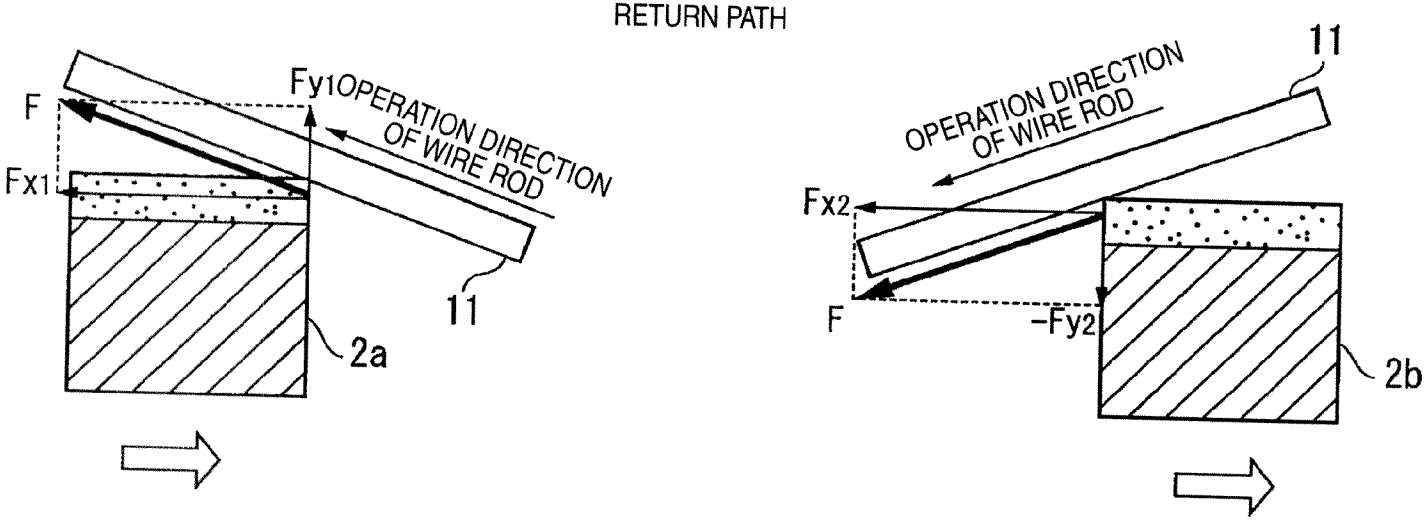
FIG. 3B is an explanatory view showing a force acting on the bilateral cleaning member in FIG. 2C.

Conversely, if all the cleaning members 2 (2*a* to 2*c*) are moved in the return direction as indicated by the arrow as shown in FIG. 2C, in the bilateral cleaning member 2*b* located in the return direction across the intermediate cleaning member 2*c*, the charging wire rod 11 is relatively moved along with the movement of the bilateral cleaning member 2*b*. An action force F (Fx2, −Fy2) acts on the bilateral cleaning member 2*b* in the operation direction of the charging wire rod 11 from the bilateral cleaning member 2*b* to the intermediate cleaning member 2*c*. The bilateral cleaning member 2*b* is inclined in the direction away from the charging wire rod 11 around the fixed point of the cleaning member that is the central fixed point of the support member 6, as shown in FIG. 3B.

On the other hand, in the bilateral cleaning member 2*a* located on the opposite side in the return direction across the intermediate cleaning member 2*c*, the charging wire rod 11 is relatively moved along with the movement of the bilateral cleaning member 2. An action force F (Fx1, Fy1) acts on the bilateral cleaning member 2*a* in the operation direction of the charging wire rod 11 from the intermediate cleaning member 2*c* to the bilateral cleaning member 2*a*. The bilateral cleaning member 2*a* is inclined in the direction pushing against the charging wire rod 11 around the fixed point of the cleaning member that is the central fixed point of the support member 6, as shown in FIG. 3B.

In this way, the inclination of the bilateral cleaning members 2*a* and 2*b* is reversed, depending on whether the movement direction of the cleaning member 2 is in the outward direction or the return direction, but a force for cleaning the charging wire rod 11 with both the bilateral cleaning members 2*a* and 2*b* is equal by addition. Thereby, even if the movement direction of the cleaning member 2 is different, the cleaning force with the bilateral cleaning members 2*a* and 2*b* and the intermediate cleaning member 2*c* is kept almost equal, thereby avoiding a situation where the cleaning force with the cleaning members 2 is extremely lower due to a difference in the movement direction between the cleaning members 2.

Figure 4A:
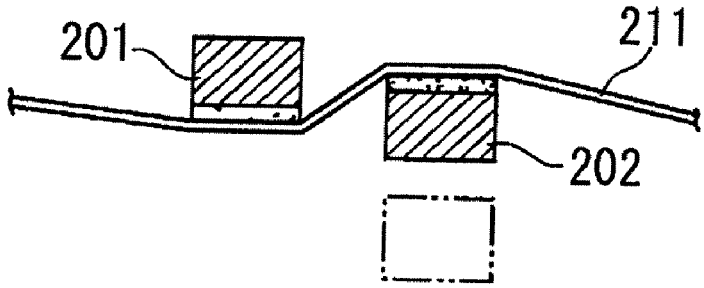
FIG. 4A is an explanatory view showing the outline of the behavior of the cleaning device for use in a comparative form.

In evaluating the basic performance of this exemplary embodiment, the performance of a comparative form (including two cleaning members 201 and 202) is contrasted as shown in FIG. 4A.

In this comparative form, it is assumed that two cleaning members 201 and 202 are arranged across a charging wire rod 211, in which the cleaning member 202, for example, is arranged to be freely contacted or separated by the wire rod contact/separation mechanism and the cleaning movement mechanism, not shown and the other cleaning member 201 is fixed and arranged on the support member, not shown, so that two cleaning members 201 and 202 are moved in the outward direction and the return direction as indicated by the arrow in a state where they are in contact with the charging wire rod 211.

Figure 4B:
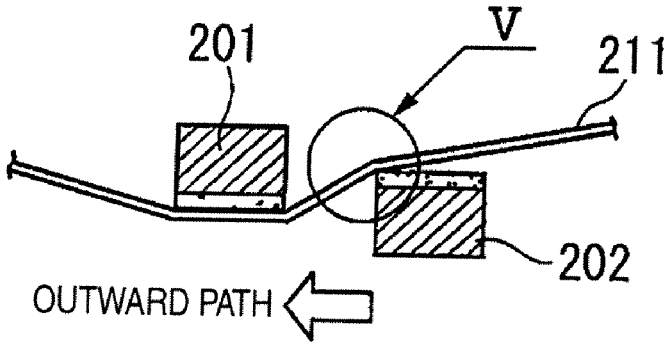
FIG. 4B is an explanatory view showing the behavior of the cleaning device during its movement in the outward path.
Figure 4C:
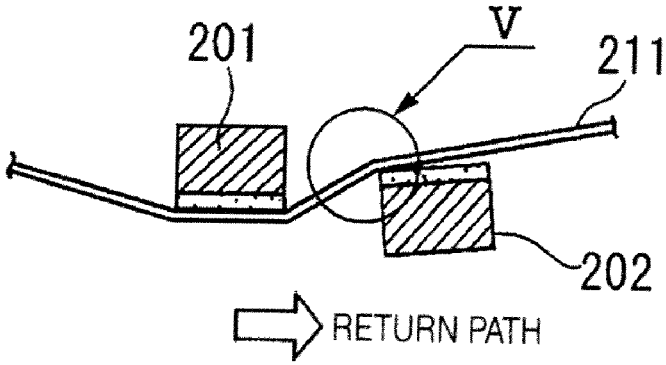
FIG. 4C is an explanatory view showing the behavior of the cleaning device during its movement in the return path.
Figures 5A, 5B:
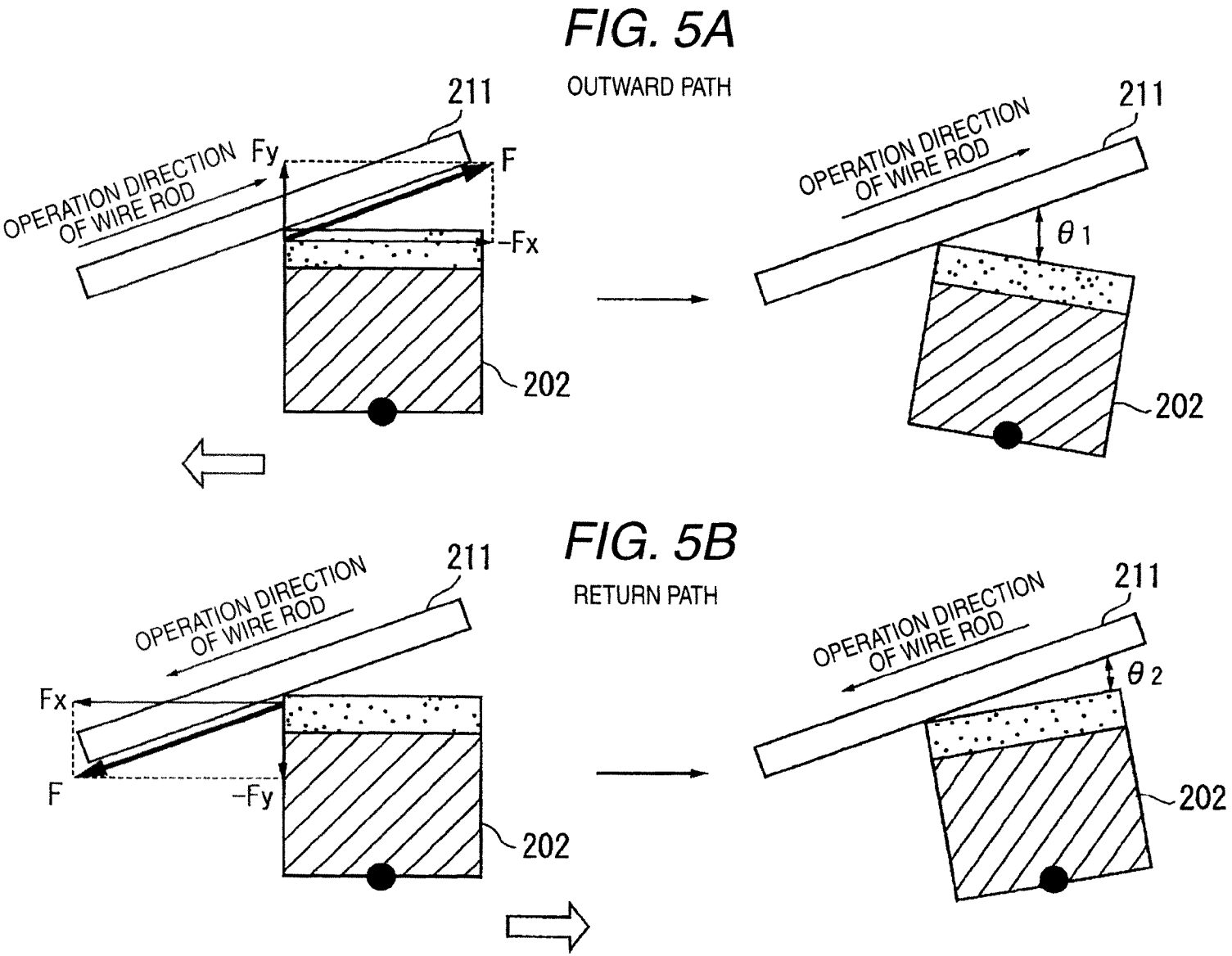
FIG. 5A is an explanatory view showing a force acting on a V portion in FIG. 4B.
FIG. 5B is an explanatory view showing a force acting on the V portion in FIG. 4C.

Herein, if two cleaning members 201 and 202 are moved in the outward direction as indicated by the arrow as shown in FIG. 4B, in the cleaning member 202 located on the opposite side in the outward direction, the charging wire rod 211 is relatively moved along with the movement of the cleaning member 202. An action force F (−Fx, Fy) acts on the cleaning member 202 in the operation direction of the charging wire rod 211 from the one cleaning member 201 to the other cleaning member 202 The cleaning member 202 pushes against the charging wire rod 211 around a fixed point of the cleaning member 202 and is inclined at an angle $\theta_1$ in the direction away from the charging wire rod 211, as shown in FIG. 5A On the other hand, if two cleaning members 201 and 202 are moved in the return direction as indicated by the arrow as shown in FIG. 4C, in the cleaning member 202 located in the return direction the charging wire rod 211 is relatively moved along with the movement of the cleaning member 202. An action force F (Fx, −Fy) acts on the cleaning member 202 in the operation direction of the charging wire rod 211 from the cleaning member 202 to the other cleaning member 201. The cleaning member 202 is moved in the direction away from the charging wire rod 211 around the fixed point of the cleaning member 202 and inclined at an angle $\theta_2(\theta_2<\theta_1)$ in the direction approaching the charging wire rod 211, as shown in FIG. 5B.

In this way, in the comparative form, since the inclination of the cleaning member 202 with respect to the charging wire rod 211 is different depending on whether the movement direction of the cleaning members 201 and 202 is in the outward direction or the return direction. There is a difference in the cleaning force with the cleaning member 202 between the outward direction or the return direction. Thus, it is apprehended that the cleaning force is insufficient depending on the movement direction of the cleaning members 201 and 202.

Figure 6A:
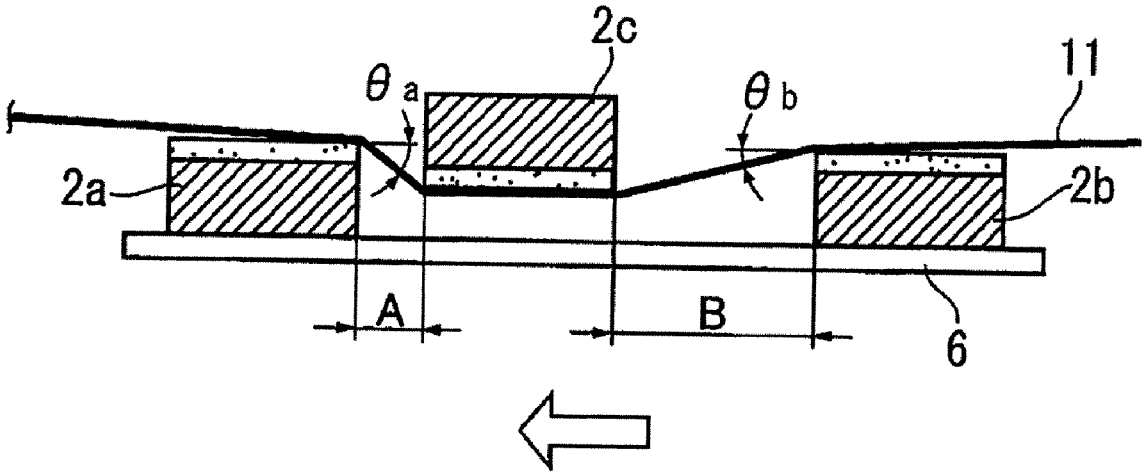
FIG. 6A is an explanatory view showing the disposed position relationship of a cleaning member in the exemplary embodiment.

In particular, in this exemplary embodiment, the cleaning position adjustment mechanism 5 adjusts the positional relationship between the cleaning members 2*a* to 2*c* so that the relationship A<B may be satisfied, for the interval A between the bilateral cleaning member 2*a* located in the movement direction and the intermediate cleaning member 2*c* and the interval B between the bilateral cleaning member 2*b* located on the opposite side in the movement direction and the intermediate cleaning member 2*c*, as shown in FIG. 6A.

At this time, assuming that the inclination angle between the bilateral cleaning member 2*a* located in the movement direction and the intermediate cleaning member 2*c* in the longitudinal direction of the charging wire rod 11 is $\theta_a$ and the inclination angle between the bilateral cleaning member 2*b* located on the opposite side in the movement direction and the intermediate cleaning member 2*c* in the longitudinal direction of the charging wire rod 11 is $\theta_b$, there is the larger or smaller relationship $\theta_a>\theta_b$.

In this state, a difference in the pressure is given on the contact surface between the cleaning members 2*a* to 2*c* and the charging wire rod 11. More specifically, the contact pressure between the bilateral cleaning member 2*a* located in the movement direction and the charging wire rod 11 is set to be larger than the contact pressure between the bilateral cleaning member 2*b* located on the opposite side in the movement direction and the charging wire rod 11. Further, the contact pressure between the intermediate cleaning member 2*c* located in the movement direction and the charging wire rod 11 is set to be larger than the contact pressure between the intermediate cleaning member 2*c* located on the opposite side in the movement direction and the charging wire rod 11.

Therefore, the dirt of the charging wire rod 11 is scraped out in the part of the cleaning members 2 (2*a*, 2*c*) having a larger contact pressure, and the scraped dirt is wiped off in the part of the cleaning member 2 (2*b*, 2*c*) having a smaller contact pressure. Thus, the dirt having strong adherence to the charging wire rod 11 is effectively cleaned.

That is, the cleaning device 1 according to this exemplary embodiment has the function separated into a dirt scraping action and a dirt wiping action of the charging wire rod 11 on the contact portions between three cleaning members 2*a* to 2*c* and the charging wire rod 11. Thus, the cleaning performance of the dirt of the charging wire rod 11 is improved.

Figure 6B:
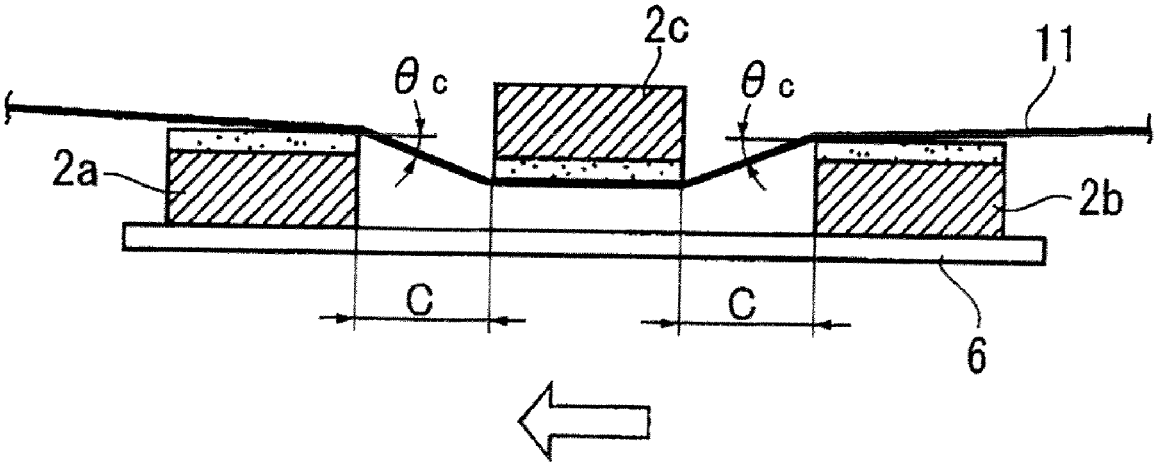
FIG. 6B is an explanatory view showing the disposed position relationship of the cleaning member in the comparative form 1.

At this point, in the comparative form I as shown in FIG. 6B, in the layout of three cleaning members 2*a* to 2*c*, the bilateral cleaning members 2*a* and 2*b* are arrange in symmetry around the intermediate cleaning member 2*c* in the longitudinal direction of the charging wire rod 11. The intervals C between the bilateral cleaning members 2*a* and 2*b* and the intermediate cleaning member 2*c* are equal with each other. The inclination angles $\theta_c$ between the bilateral cleaning members 2*a* and 2*b* and the intermediate cleaning member 2*c* in the longitudinal direction of the charging wire rod 11 are equal. The pressure on the contact surface between the cleaning members 2*a* to 2*c* and the charging wire rod 11 is constant. Therefore, the separation function of the cleaning performance as in this exemplar embodiment may not implemented.

Also, assuming that the layout of three cleaning members 2*a* to 2*c* is such that A>B for A and B as shown in FIG. 6A, unlike this exemplary embodiment or the comparative form 1, there is the larger or smaller relationship of $\theta_a<\theta_b$, whereby a difference in the pressure is given on the contact surface between the cleaning members 2*a* to 2*c* and the charging wire rod 11, though the contact pressure between the bilateral cleaning member 2*a* located in the movement direction and the charging wire rod 11 is set to be smaller than the contact pressure between the bilateral cleaning member 2*b* located on the opposite side in the movement direction and the charging wire rod 11, and further the contact pressure between the intermediate cleaning member 2*c* located in the movement direction and the charging wire rod 11 is set to be smaller than the contact pressure between the intermediate cleaning member 2*c* located on the opposite side in the movement direction and the charging wire rod 11.

In this state, when the cleaning members 2*a* to 2*c* are moved along the charging wire rod 11, first the cleaning member 2 (2*a*,2*c*) having a smaller contact pressure makes contact with a predetermined part of the charging wire rod 11, and later the cleaning member 2 (2*b*,2*c*) having a larger contact pressure makes contact with it, whereby it is apprehended that the dirt scraping action is substantially performed mainly in the part of the cleaning member 2 (2*b*, 2*c*) having larger contact pressure, and the part of the cleaning member 2 (2*a*, 2*c*) having smaller contact pressure does not directly contribute to the cleaning performance for the charging wire rod 11.

This invention will be described below in more detail based on the exemplary embodiments as shown in the accompanying drawings.

Exemplary Embodiment 1

Overall Constitution of Image Forming Apparatus

Figure 7:
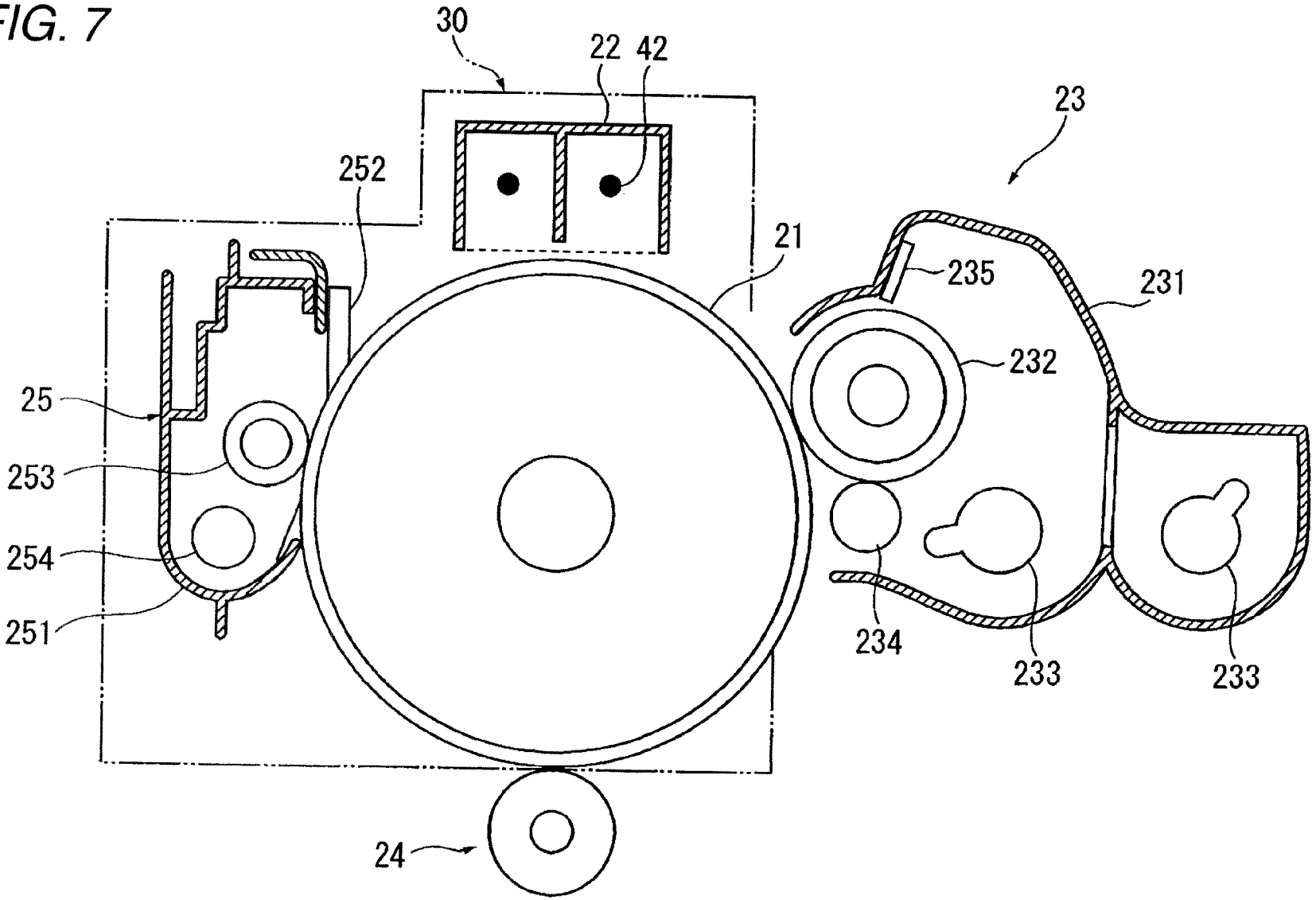
FIG. 7 is an explanatory view showing an image forming apparatus according to an exemplary embodiment of the invention.

FIG. 7 is an explanatory view showing an embodiment 1 of an image forming apparatus to which the invention is applied.

In FIG. 7, the image forming apparatus includes a photoconductor 21 as an image carrier that is rotated in a predetermined direction, a charger 22 for charging this photoconductor 21, an exposure unit as a latent image write device for writing an electrostatic latent image on the charged photoconductor 21, a developing unit 23 for developing the electrostatic latent image on the photoconductor 21 with a developer into a visible image, a transfer unit 24 for transferring the visible image with the developer on the photoconductor 21 onto a recording material or intermediate transfer body, not shown, and an image cleaning device 25 for cleaning the visible image with the developer remaining on the photoconductor 21.

Herein, though the developing unit 23 may be appropriately selected, whether the single-component development method or the two-component development method, the form of the two-component development method (e.g., a developing roll 232 is disposed in a developer container 231 in which the two-component developer is contained, an agitator conveying member 233 for conveying the developer while agitating it is disposed within the developer container 231 the developer agitated and conveyed by the agitator conveying member 233 is supplied to a developing roll 234 using a developer supply roll 234, the developer layer thickness on the developing roll 232 is regulated by a layer thickness regulation member 235, and the developer is supplied to a development area opposed to the photoconductor 21) is employed in this exemplary embodiment.

Also, the transfer unit 24 is not limited to the above form of using the transfer roll, as shown in FIG. 7, as far as it has a functional member of transferring the visible image on the photoconductor 21 to the recording material or intermediate transfer body, but may be in the form of using a discharge wire. In this exemplary embodiment, if the transfer unit 24 is in the form of using the discharge wire, the charger 22 may adopt the form of using the discharge wire.

Further, the image cleaning device 25 may be appropriately selected, as far as it cleans the residual developer on the photoconductor 21, but in this exemplary embodiment, a plate cleaning blade 252 and a cleaning brush 253 are disposed within a cleaning container 251, and a homogenizing carrying member 254 for homogenizing the withdrawn residual developer is disposed within the cleaning container 251.

Figure 8:
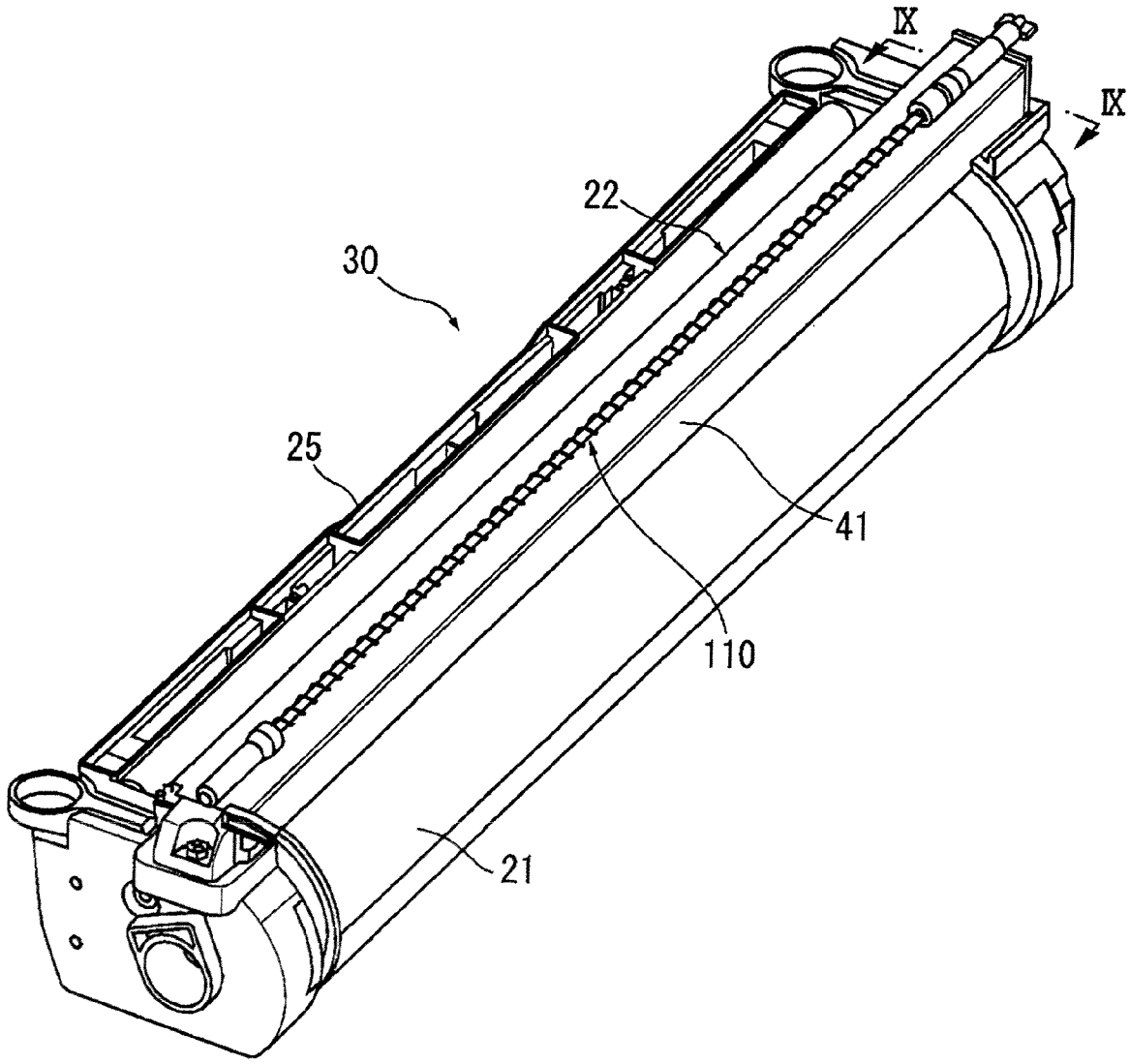
FIG. 8 is an explanatory view showing the overall constitution of an image carrier unit for use in the exemplary embodiment 1.
Figure 9:
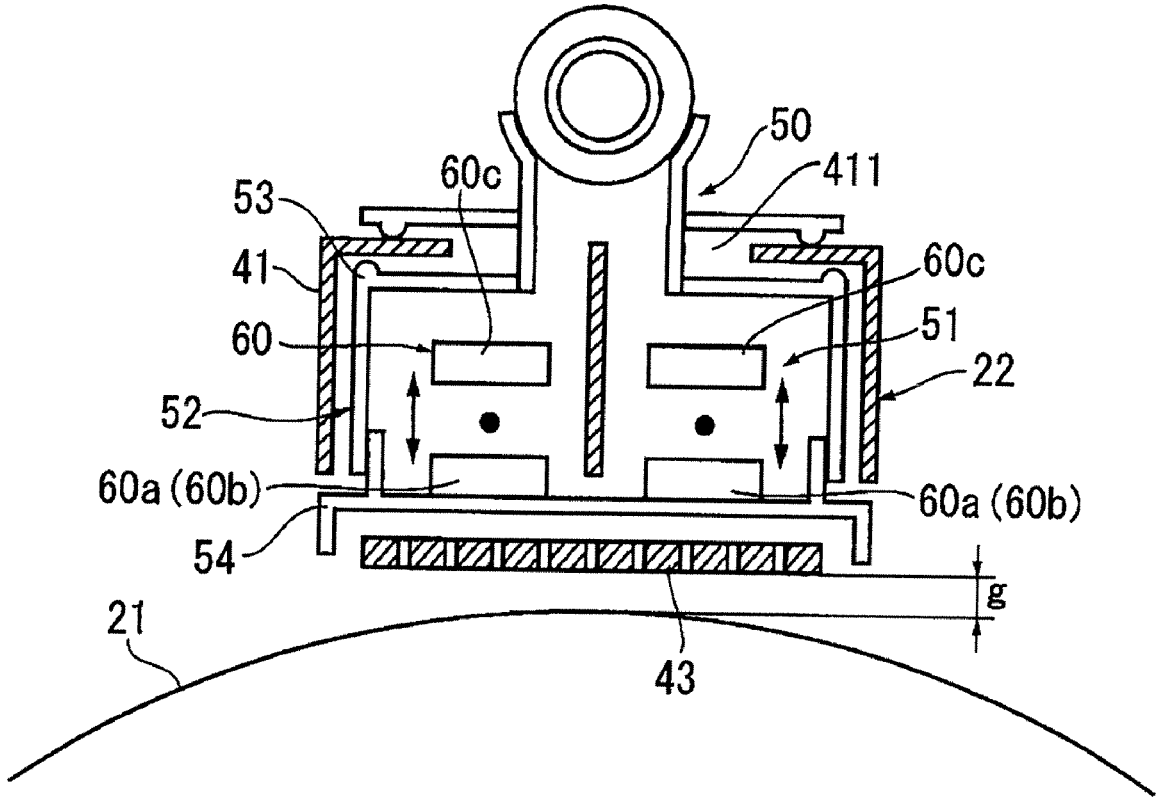
FIG. 9 is an explanatory cross-sectional view taken along the line IX-IX in FIG. 8.

In particular, in this exemplary embodiment, the photoconductor 21, the charger 22 and the image cleaning device 25 are one unit as an image carrier unit 30, as shown in FIGS. 7 to 9.

Basic Constitution of Charger

The charger 22 includes a charging housing 41 arranged out of contact via a gap above the photoconductor 21, and formed like E-character in cross section opened to the side of the photoconductor 21 by a material extending along the axial direction of the photoconductor 21 and shielding the discharge, a discharge wire 42 as the charging wire rod provided along the length direction of this charging housing 41, and a lattice electrode 43, provided in the opening portion of the charging housing 41 to be spaced a predetermined size g from the photoconductor 21, for adjusting the charging potential of the photoconductor 21.

Herein, the charging housing 41 is formed like E-character in cross section to accommodate a plurality of discharge wires 42, but may be formed like U-character in cross section, for example, in a form of accommodating one discharge wire 42. Also, the discharge wire 42 is stretched via an elastic spring (not shown) for applying tension on at least one side between the insulation members provided at both ends of the charging housing 41 in the longitudinal direction, and connected to a discharge bias power source, not shown. The number of discharge wires 42 is at least one or more, and one pair is provided in this exemplary embodiment.

Also, the discharge wire 42 is made of tungsten, carbon tungsten, gold plated tungsten, and has a wire diameter of 30 μm to 40 μm, in which the tensile force is set to about 30 to 80 gf (0.29 to 0.78N).

Basic Constitution of Cleaning Device

Further, in this exemplary embodiment, the charger 22 includes a cleaning device 50 for cleaning the discharge wire 42 periodically, as shown in FIGS. 8 to 11.

In this exemplary embodiment, the charging container 41 is formed to be longer than the maximum image forming area of the photoconductor 21 in the axial direction, and a cleaning wait room (not shown) where the cleaning device 50 may wait during non-cleaning is reserved at one end thereof.

Herein, the cleaning device 50 includes a cleaning tool 51 for cleaning the discharge wire 42 and a cleaning movement mechanism 110 for moving this cleaning tool 51 along the longitudinal direction of the charging container 41

Cleaning Tool

In this exemplary embodiment, the cleaning tool 51 has a movable board 52 movable along the longitudinal direction of the charging housing 41, and three cleaning pads 60 (60*a* to 60*c*) spaced along the length direction of the discharge wire 42 that are provided on the movable board 52.

Figure 12:
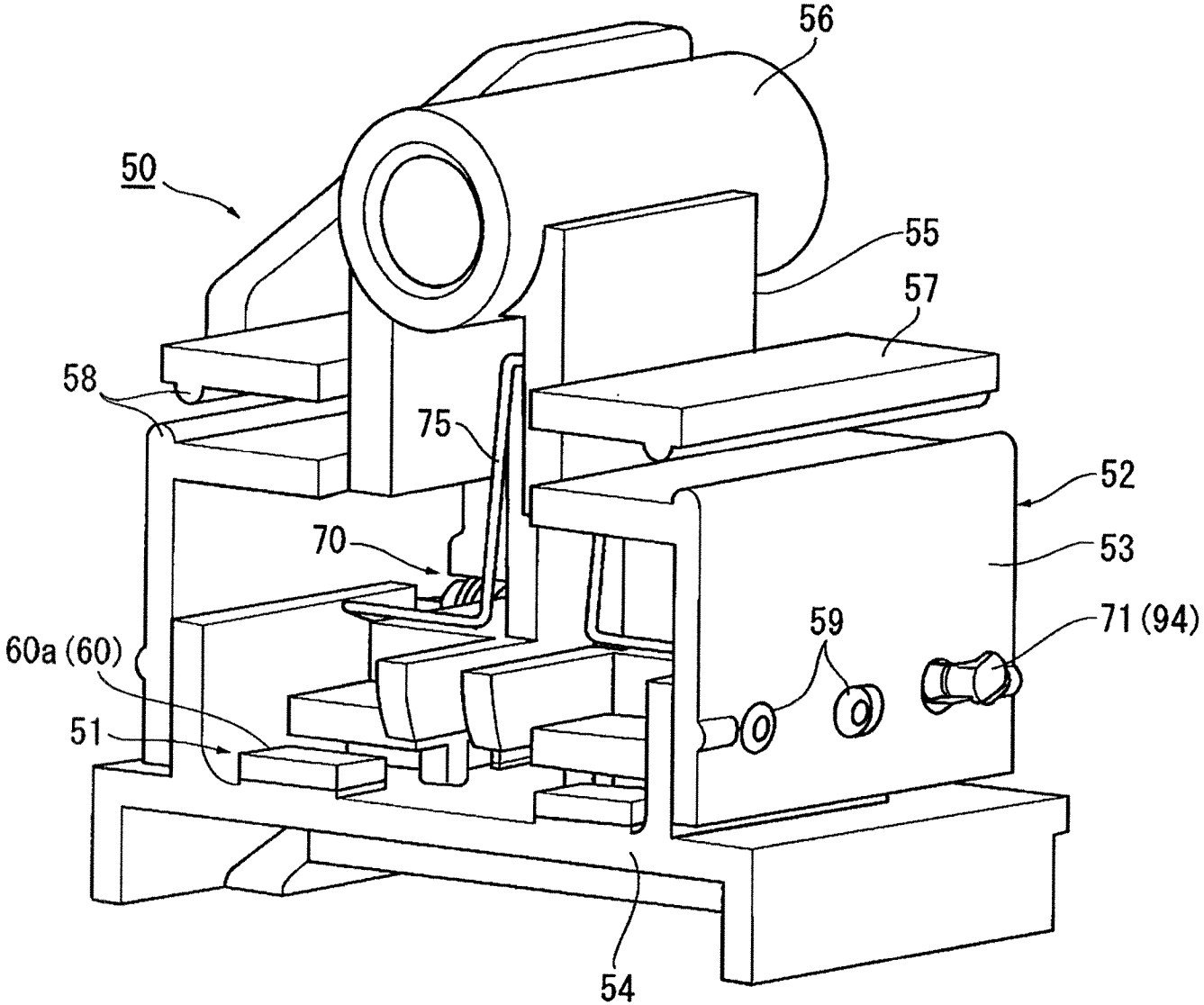
FIG. 12 is an explanatory perspective view showing the essence of the cleaning device for use in the exemplary embodiment 1.

The movable board 52 has a support frame 53 having the shape of reverse U-character that is slidable along the longitudinal direction of the charging housing 41, as shown in FIG. 12. This support frame 53 is provided with a cleaning receiving member 54 for covering the lower side of each cleaning pad 60 (60*a* to 60*c*), and one pair of protruding arms 55 protruding from a guide groove 411 (see FIG. 9) formed on the top of the charging housing 41 and extending along the longitudinal direction to the outside of the charging housing 41 and fitted slidably. A drive transmission barrel 56 internally formed with an internal thread portion (one element of a cleaning movement mechanism 110 as will be described later) is provided at the top end of this protruding arm 55, and one pair of guide plates 57 are protruded to secure a space above the top portion of the support frame 53 on both sides of the protruding arm 55, so that the top portion of the charging housing 41 is arranged freely slidably between the top portion of the support frame 53 and the guide plate 57 as shown in FIG. 12.

And a guide projection 58 extending in the movement direction of the movable board 52 is provided at the top portion of the support frame 53 and a part of the guide plate 57, and when only the guide projection 58 contacts the top portion of the charging housing 41, the contact resistance between the movable board 52 and the charging housing 41 is reduced.

Reference numeral 59 denotes a mount hole for firmly mounting the support frame 53 and the cleaning receiving member 54 by a fastener.

Also, in this exemplary embodiment, one pair of bilateral cleaning pads 60*a* and 60*b* that may contact the surface of the discharge wire 42 on the side of the photoconductor 21 are fixed and arranged on the cleaning receiving member 54. While on the other hand, an intermediate cleaning pad 60*c* is arranged movably on the support fame 53 via a wire rod contact'separation mechanism 70 and a cleaning position adjustment mechanism 90 (see FIG. 10) on the other side in the direction across the discharge wire 42 and in the middle between the bilateral cleaning pads 60*a* and 60*b* in the length direction of the discharge wire 42.

Figure 13:
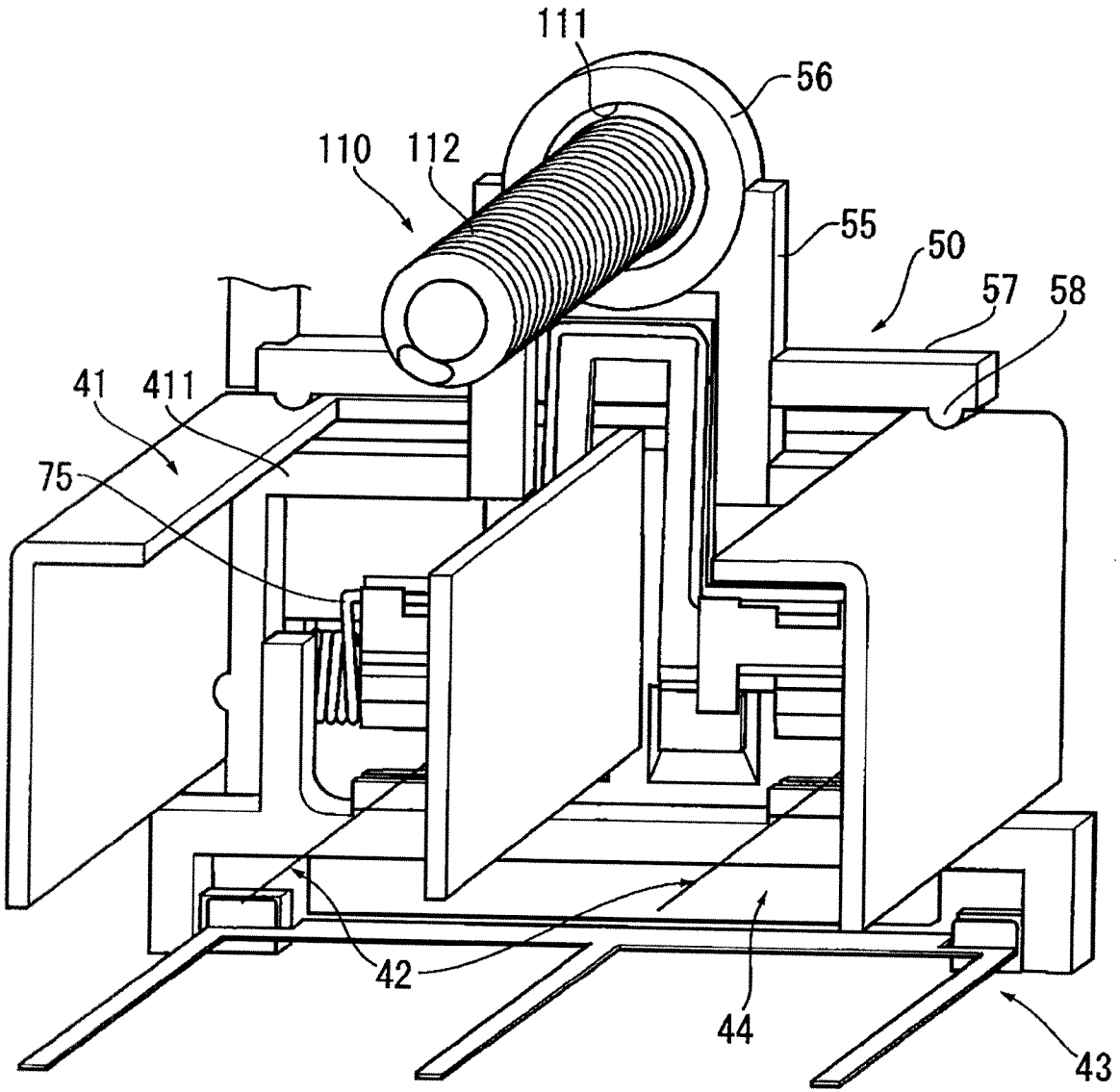
FIG. 13 is an explanatory view showing the relationship between the cleaning device and a charging housing for use in the exemplary embodiment 1.
Figure 14:
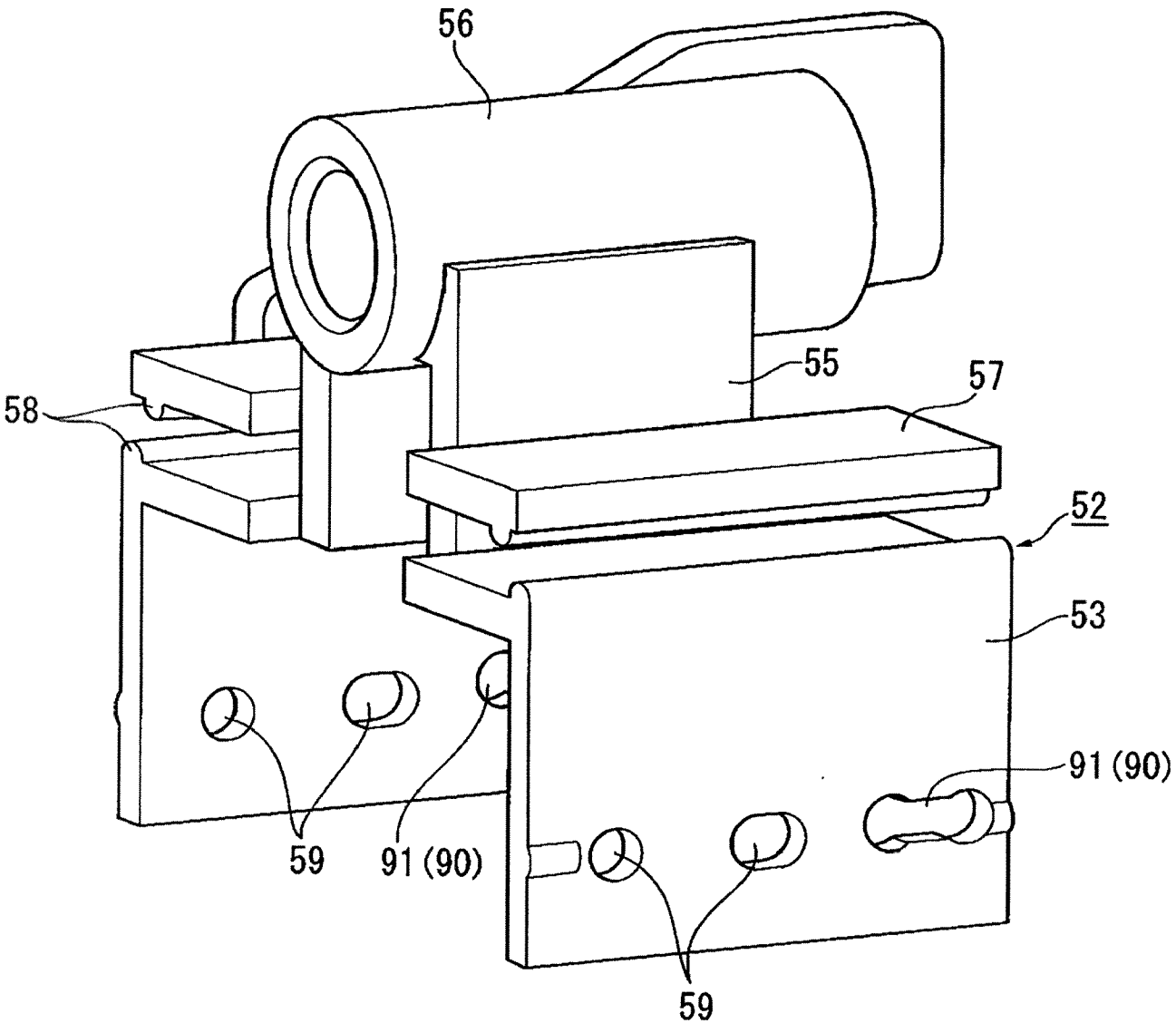
FIG. 14 is an explanatory view showing a movable board of the cleaning device for use in the exemplary embodiment 1.

In FIG. 13, a cleaning pad 44 for cleaning the lattice electrode 43 is provided on the bottom of the movable board 52, as needed.

Constitution Example of Cleaning Pad

In this exemplary embodiment, the cleaning pads 60 (60*a* to 60*c*) may be appropriately selected as far as it may clean the discharge wire 42, but are configured in consideration of the cleaning property in the same way as follows.

Figure 10A:
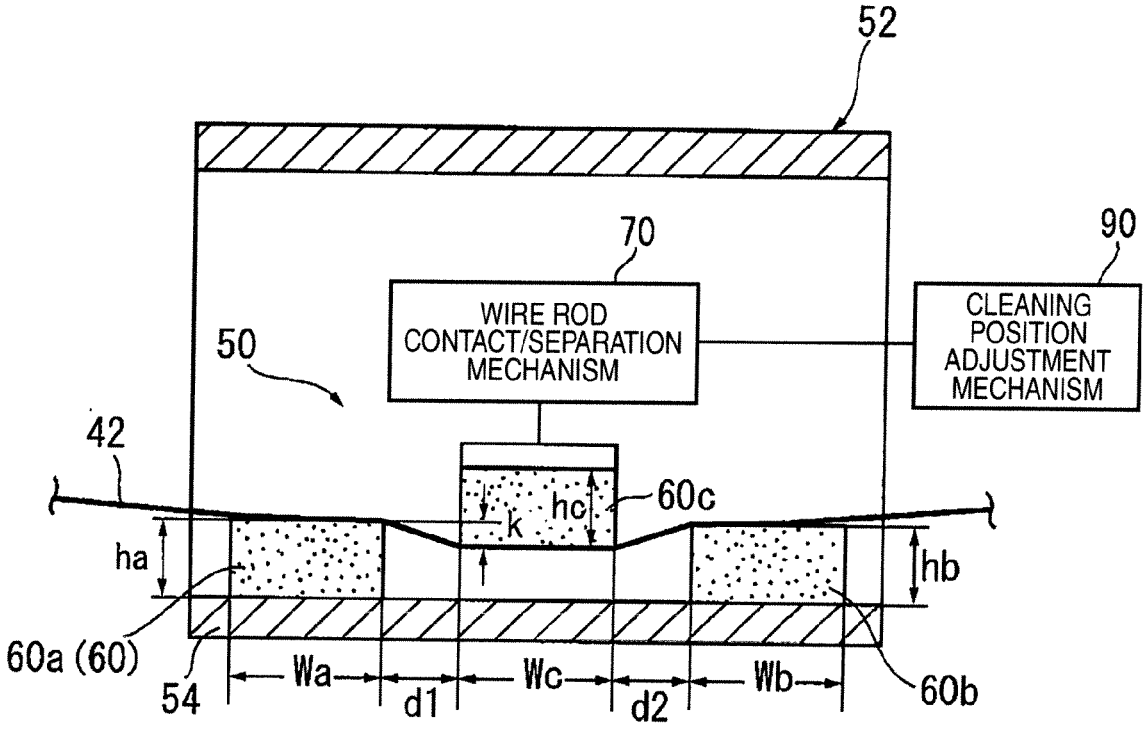
FIG. 10A is an explanatory cross-sectional view showing the outline of the cleaning device for use in the exemplary embodiment 1.
Figure 10B:
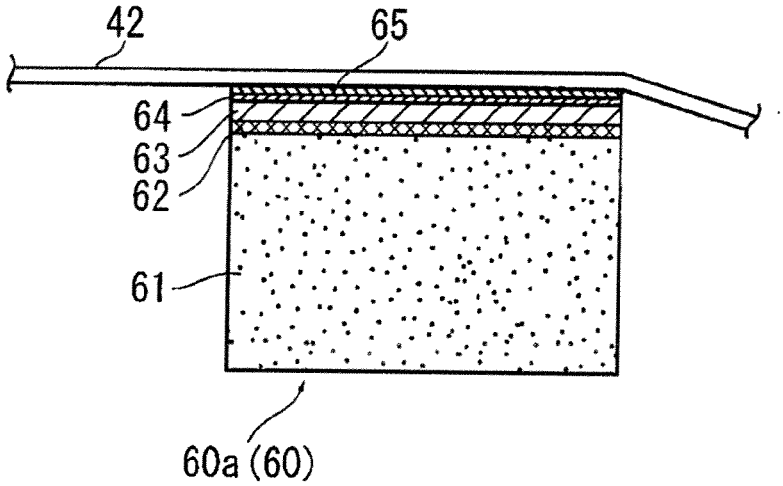
FIG. 10B is an explanatory view showing a constitution example of a cleaning pad for use in the exemplary embodiment 1.
Figure 11:
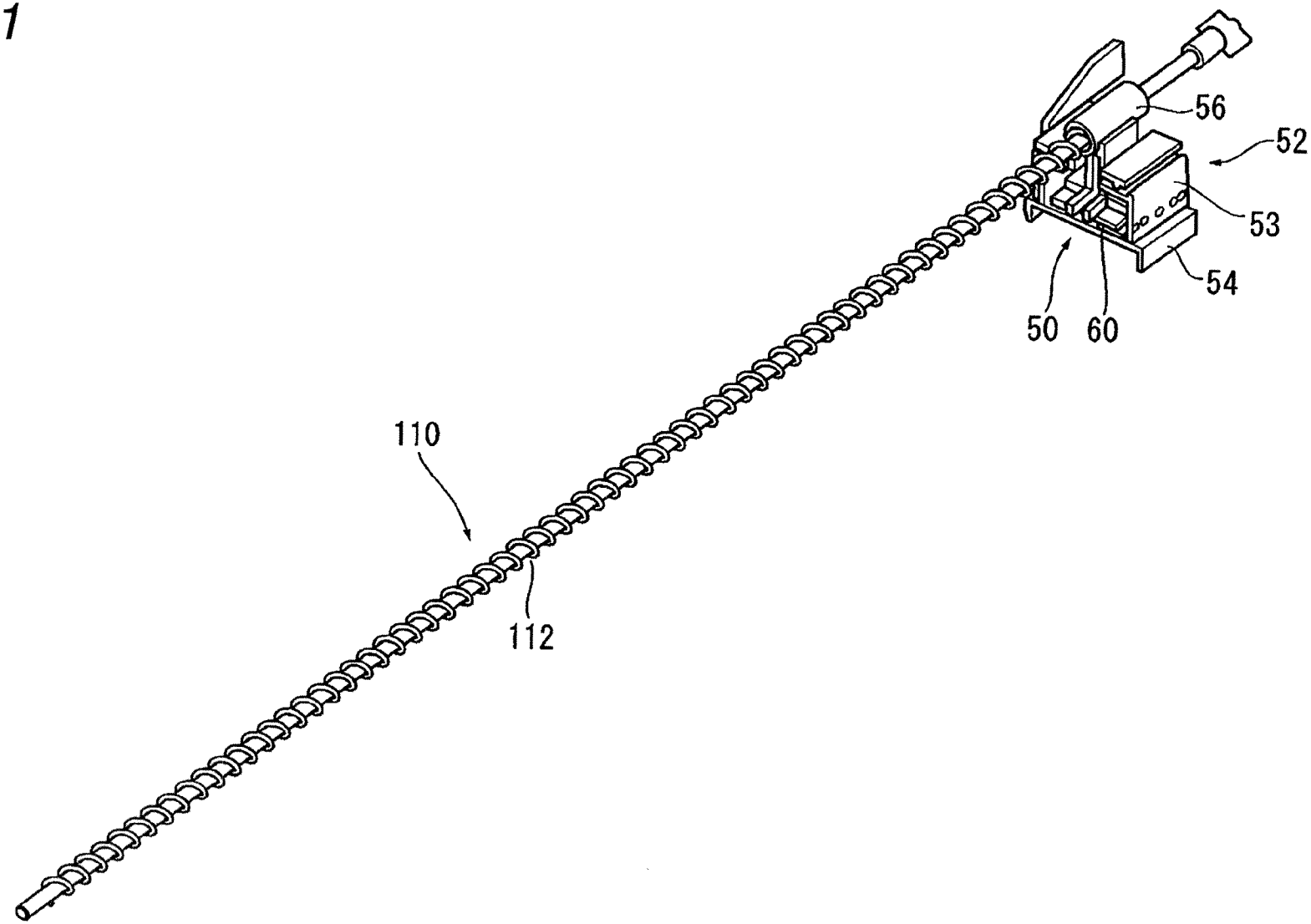
FIG. 11 is an explanatory perspective view showing the overall constitution of the cleaning device for use in the exemplary embodiment 1.

That is, the cleaning pad 60 has an elastic base material 61 that is porous and has flexibility such as sponge, felt, or resin foam, a non-woven fabric 63 processed for the irregular surface is bonded by an adhesive 62 on this elastic base material 61, a power layer 64 is further provided on the surface of the non-woven fabric 63, and a polishing material 65 having a polishing function such as alumina, carbon random or diamond, mixed into the adhesive 62, is coated on the power layer 64, or the adhesive 62 is coated and the polishing material 65 is sprayed on the surface of the non-woven fabric 63, and the adhesive 62 is coated thinly thereon, as shown in FIG. 10B.

The non-woven fabric widely includes fabric made from fibers by adhesives or needling.

Wire Rod Contact/Separation Mechanism

In this exemplary embodiment as shown in FIGS. 10A to 15, the wire rod contact/separation mechanism 70 is provided with a swing arm 72 that may be swung around a swing shaft 71 on the side wall of the support frame 53, in which the intermediate cleaning pad 60*c* is fixed and arranged on a stationary receiving portion 73 provided at a swinging free end of the swing arm 72, the intermediate cleaning pad 60*c* being movable between a retracted position out of contact with the discharge wire 42 and a cleaning position in contact with the discharge wire 42, and the swing arm 72 is made to press a biasing spring 75 (see FIGS. 12 and 13) to urge the intermediate cleaning pad 60*c* toward the cleaning position of the intermediate cleaning pad 60*c*. The swing arm 72 is stopped at the cleaning position by a stopper, not shown.

This wire rod contact/separation mechanism 70 sets the intermediate cleaning pad 60*c* at the cleaning position by swinging the swing arm 72 with a biasing force of the biasing spring 75 pressing down the part of the discharge wire 42 corresponding to this intermediate cleaning pad 60*c*, and accordingly places the part of the discharge wire 42 corresponding to the bilateral cleaning pads 60*a* and 60*b* into contact with the bilateral cleaning pads 60*a* and 60*b*.

In particular, in this exemplary embodiment, assuming that the width size of each cleaning pad 60 (60*a* to 60*c*) along the length direction of the discharge wire 42 is w (wa to wc), the thickness is h (ha to hc), the interval between the cleaning pads 60 along the length direction of the discharge wire 42 is d (d1, d2), and the bite amount equivalent to a relative difference of the discharge wire contact surface of the intermediate cleaning pad 60*c* from the discharge wire contact surface of the bilateral cleaning pads 60*a* and 60*b* is k, it is preferred that w is set to 3 to 5 mm, h is set to 1 to 2 mm, d is set to 0.5 to 4.0 mm, and k is set to 0.4 to 1.8 mm, as shown in FIG. 10A.

In particular, it is preferred that k/d is set in the range from 0.2 to 0.7.

Herein, if k/d is less than 0.2, the contact pressure of the cleaning pads 60*a* to 60*c* on the discharge wire 42 is less sufficient, or if k/d is beyond 0.7, the contact pressure is too large. Thus, it is apprehended that the cleaning pads 60*a* to 60*c* are damaged earlier. This point will be backed up in the examples as will be described later.

In this exemplary embodiment, the size of each cleaning pad 60 (60*a* to 60*c*) and the disposed position relationship may be set individually, but from the viewpoint of suppressing a difference in the cleaning property due to a different movement direction of the cleaning tool 51 as much as possible, each cleaning pad 60 (60*a* to 60*c*) may have the same constitution, and the disposed position relationship between the cleaning pads 60*a* to 60*c* in the movement direction of the cleaning tool 51 on the outward path and the return path is similarly set.

Also, in this exemplary embodiment, the wire rod contact/separation mechanism 70 includes a retraction mechanism 80 (see FIG. 16) for retracting the intermediate cleaning pad 60*c* to the retracted position, when the cleaning tool 51 is located at an initial position and at the opposite end of the charging housing 41.

Figure 15:
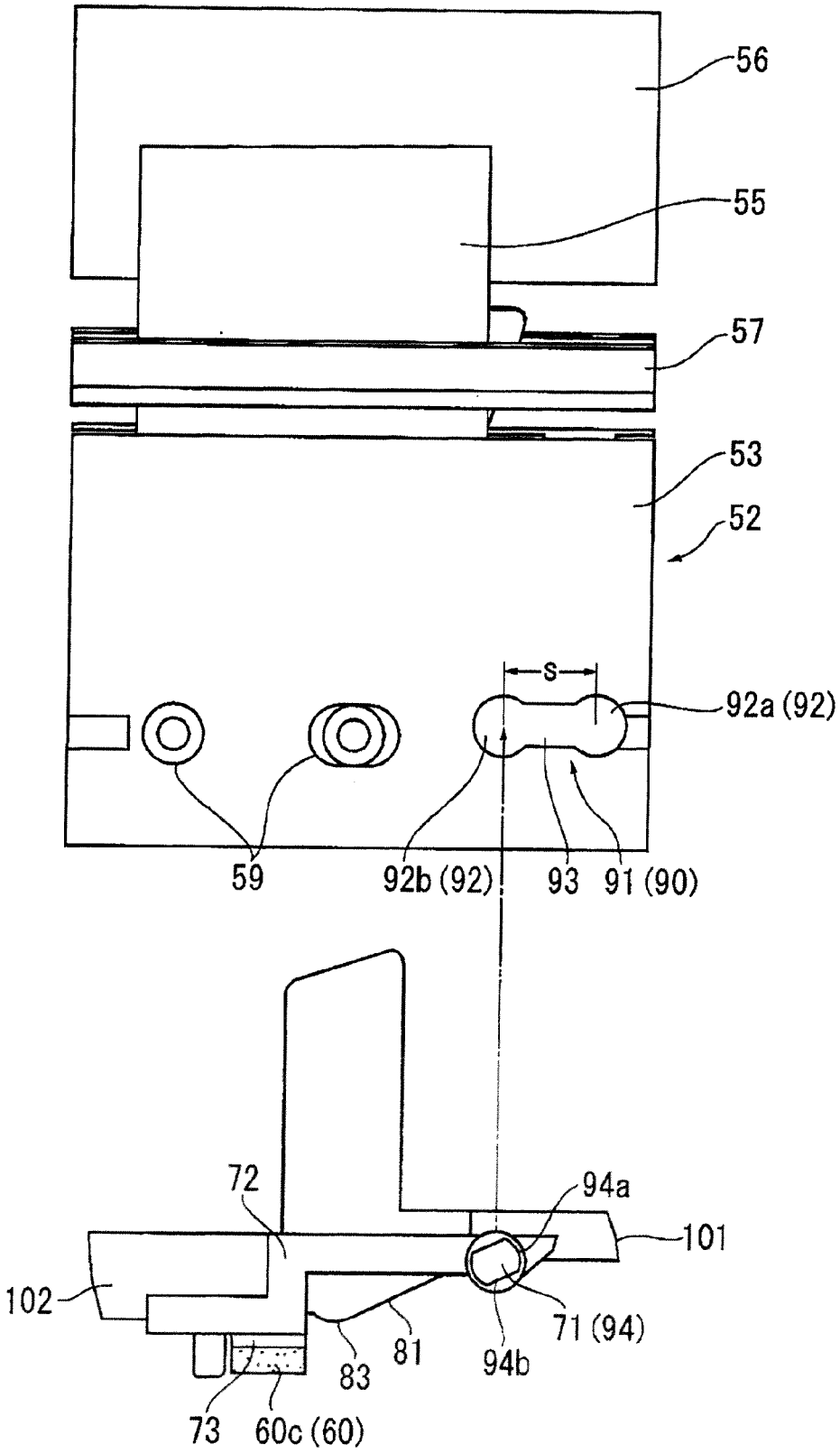
FIG. 15 is an explanatory view showing one example of a support structure of an intermediate cleaning pad for use in the exemplary embodiment 1.
Figure 16:
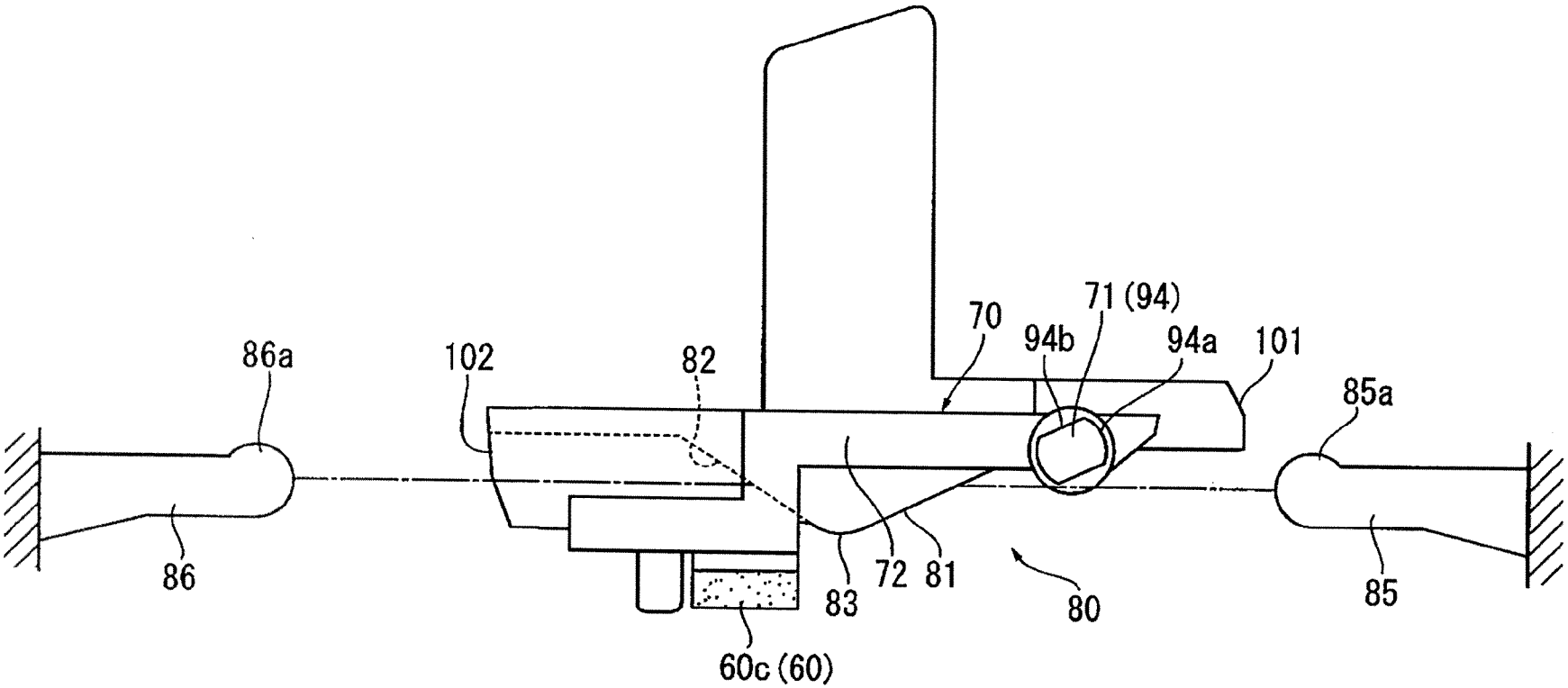
FIG. 16 is an explanatory view showing a wire rod contact/separation mechanism for use in the exemplary embodiment 1.
Figure 17A:
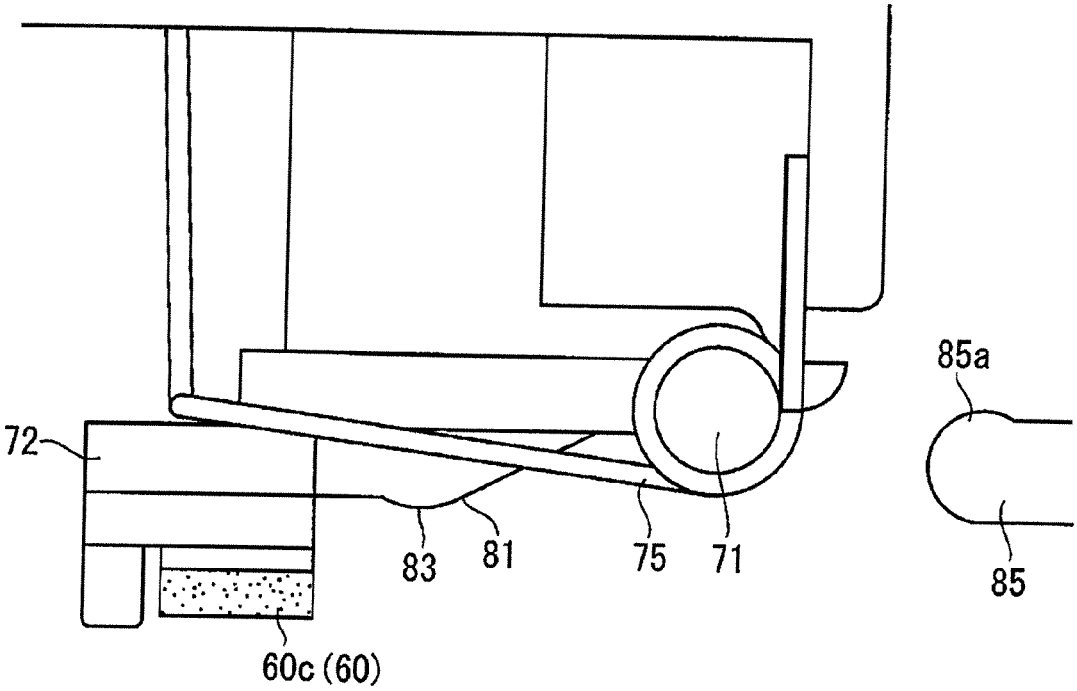
FIG. 17A is an explanatory view showing a state of a biasing spring when the intermediate cleaning pad is disposed at a cleaning position.
Figure 17B:
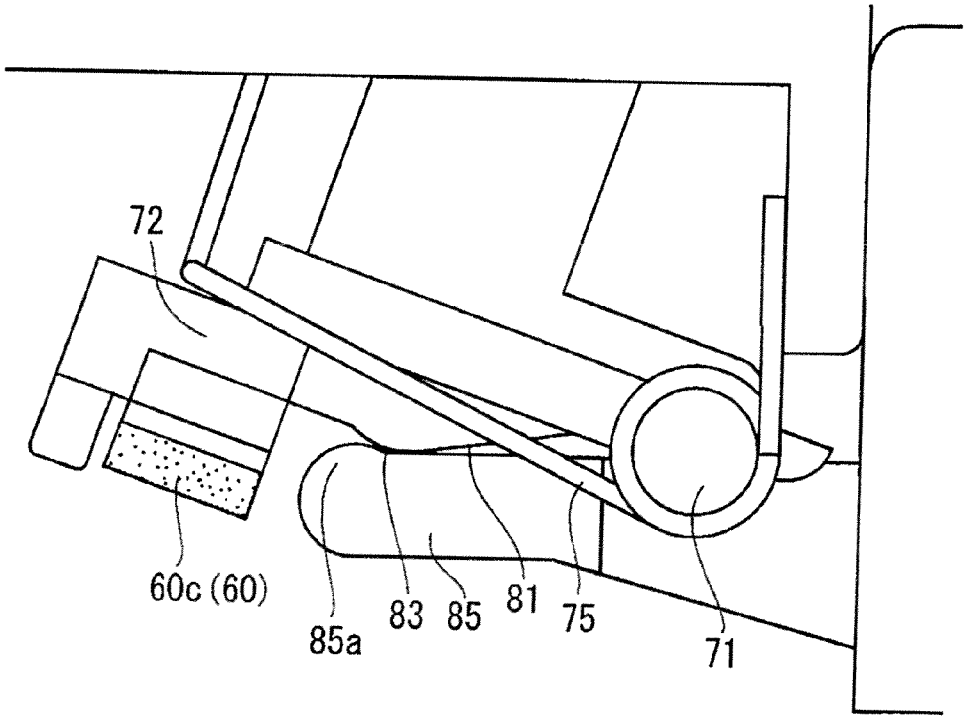
FIG. 17B is an explanatory view showing a state of the biasing spring when the intermediate cleaning pad is disposed at a retracted position.

This retraction mechanism 80 is formed with a first inclined guide plane 81 inclined obliquely downward away from the swing shaft 71 on the bottom of the swing arm 72, and a second inclined guide plane 82 inclined obliquely upward away from the swing shaft 71, as well as a hook step portion 83 like a curved surface at a lower end of each inclined guide plane 81, 82, and provided with the retracting projections 85 and 86 in the parts opposed to the inclined guide surfaces 81, 82 at both ends of the charging housing 41, as shown in FIGS. 15 to 18, whereby the retracting projections 85 and 86 are joined with the inclined guide planes 81 and 82 to push up the swing arm 72 against an urging direction of the biasing spring 75, as shown in FIGS. 17A and 17B.

The layout of the inclined guide planes 81 and 82 may be appropriately selected, and the hook step portion 83 may be provided separately according to the layout of the inclined guide planes 81 and 82, or may be shared.

In this exemplary embodiment, the top ends of the retracting projections 85 and 86, which are formed as the curved surface portions 85*a* and 86*a*, are joined with the inclined guide planes 81 and 82, and then moved along the inclined guide planes 81 and 82 with less contact resistance to get over the hook step portions 83 and catch the hook step portions 83.

Figure 18:
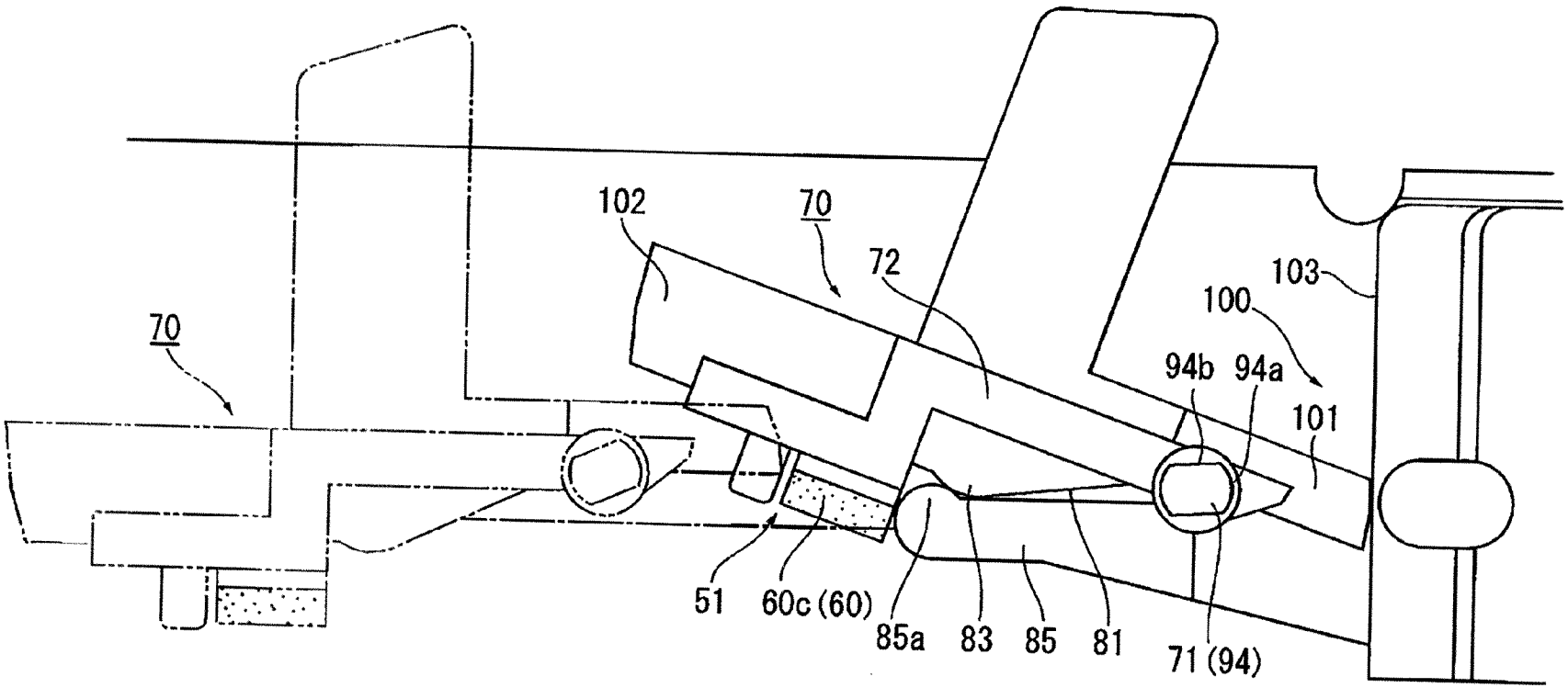
FIG. 18 is an explanatory view showing an operation process of the wire rod contact/separation mechanism in the exemplary embodiment 1.
Figure 19:
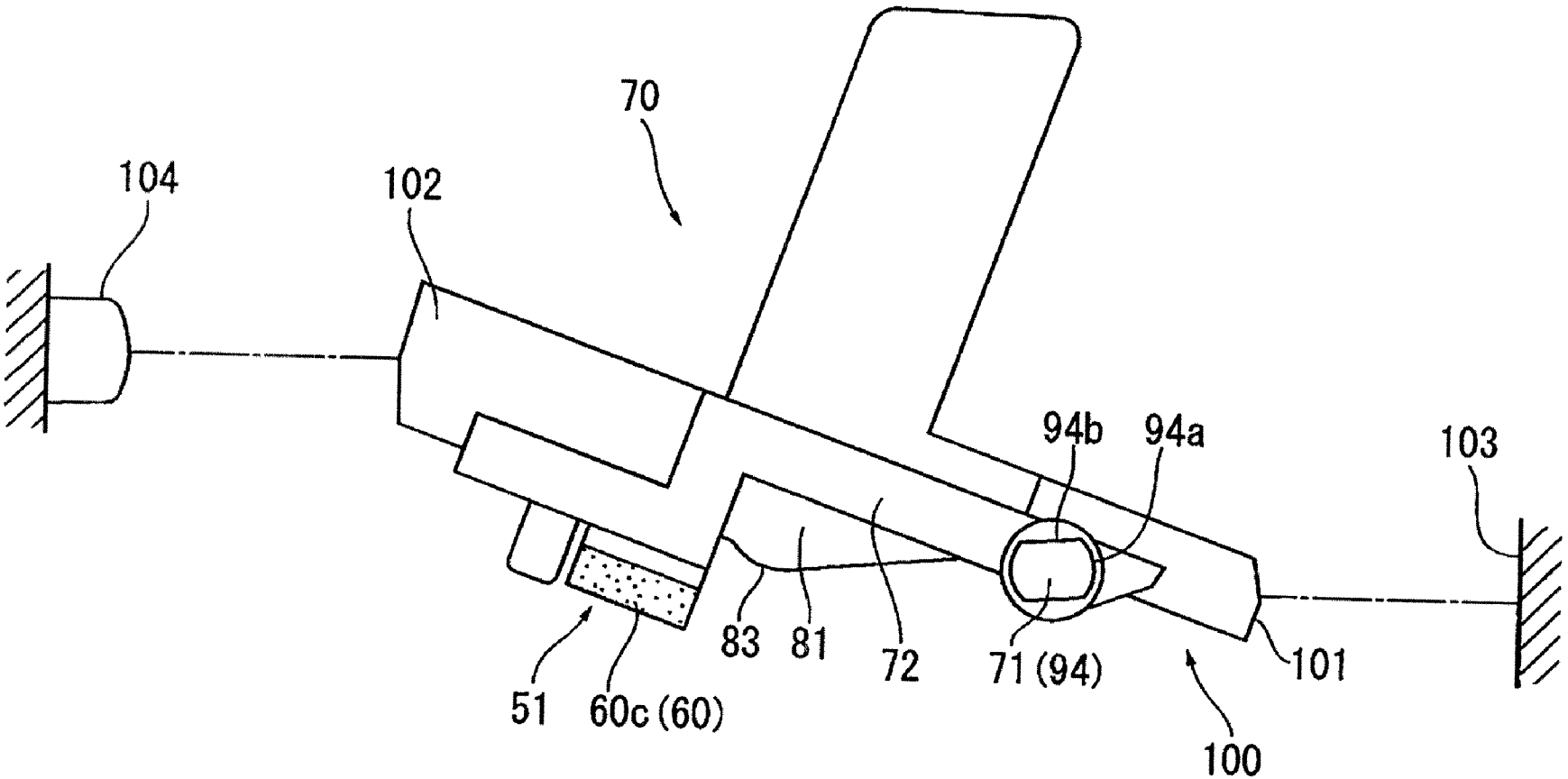
FIG. 19 is an explanatory view showing a position change mechanism for a cleaning position adjustment mechanism for use in the exemplary embodiment 1.

Therefore, in this exemplary embodiment, when the cleaning tool 51 is moved from the non-initial position to the initial position, the intermediate cleaning pad 60*c* is arranged at the cleaning position as indicated by the imaginary line at first, but if the retracting projection 85 is joined with the inclined guide plane 81 of the swing arm 72, the swing arm 72 is pushed up as the cleaning tool 51 advances to the initial position, so that when the top of the retracting projection 85 catches the hook step portion 83 of the swing arm 72, the intermediate cleaning pad 60*c* is moved to the retracted position, as shown in FIG. 18. In this state, each cleaning pad 60 (60*a* to 60*c*) is arranged out of contact with the discharge wire 42.

On the other hand, if the cleaning tool 51 starts to be moved from the initial position along the longitudinal direction of the charging housing 41, the positional constraint of the swing arm 72 with the retracting projection 85 is relieved, as the cleaning tool 51 is moved, as indicated by the solid line and imaginary line in FIG. 18, so that the swing arm 72 is pushed down due to an urging force of the biasing spring 75 to set the intermediate pad 60 from the retracted position to the cleaning position. Therefore, the discharge wire 42 is placed in contact with each cleaning pad 60 (60*a* to 60*c*).

Further, if the cleaning tool 51 arrives at the end of the charging housing 41 opposite to the initial position, the same operation as above is performed between the inclined guide plane 82 of the swing arm 72 and the retracting projection 86, and the intermediate cleaning pad 60*c* is once moved to the retracted position, and then moved to the cleaning position, as shown in FIG. 16.

Cleaning Position Adjustment Mechanism

In the exemplary embodiment, a cleaning position adjustment mechanism 90 for adjusting the disposed position of the cleaning pads 60 (60*a* to 60*c*) variably according to the movement direction of the cleaning tool 51 is provided, as shown in FIG. 10A.

This cleaning position adjustment mechanism 90 variably sets the relative positional relationship of the intermediate cleaning pad 60*c* with the bilateral cleaning pads 60*a* and 60*b* by moving the position of the swing arm 72 for the wire rod contact/separation mechanism 70 along the longitudinal direction of the discharge wire 42.

Figure 25:
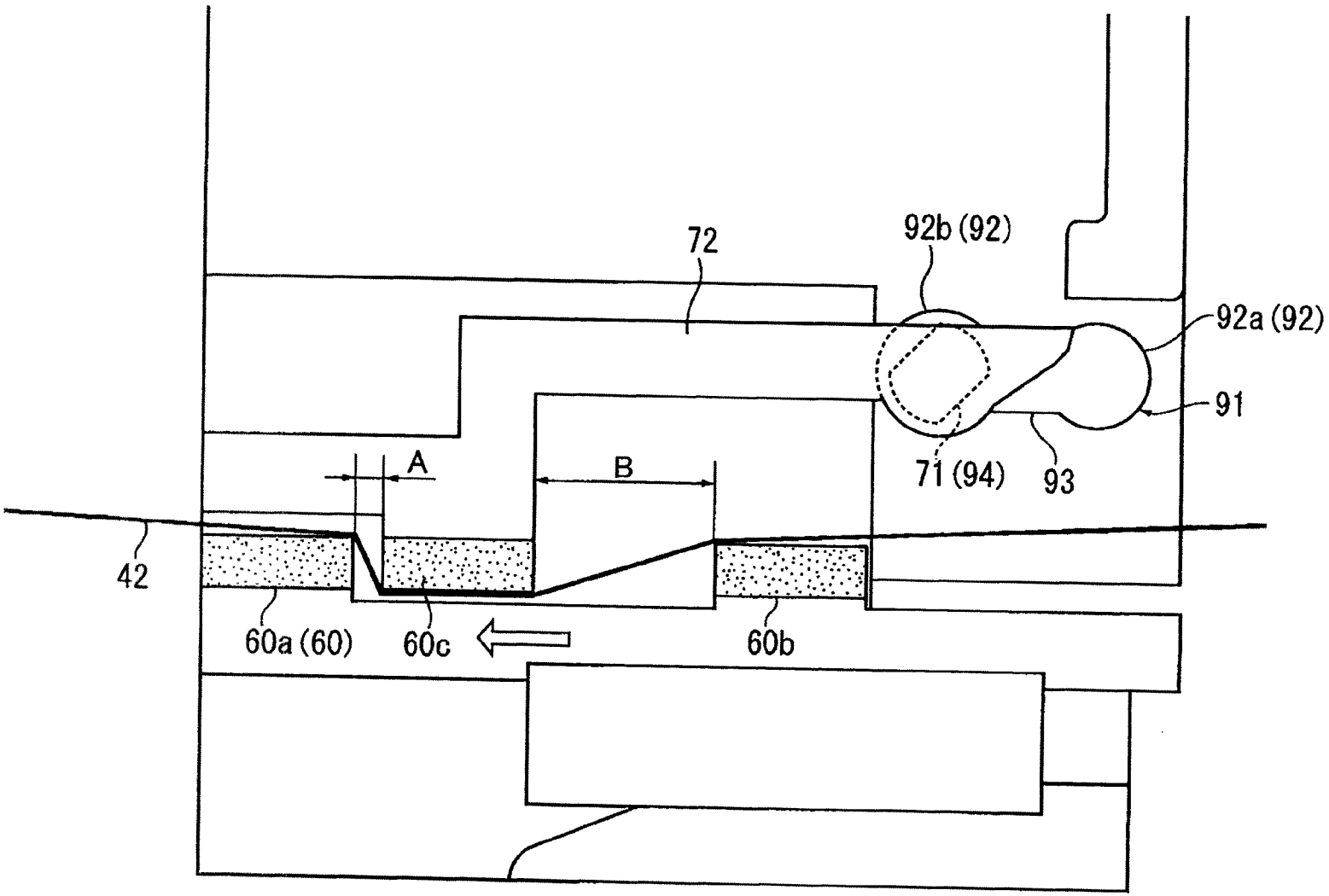
FIG. 25 is an explanatory view showing the disposed position relationship of the cleaning pad when the cleaning device is moved in the outward direction.
Figure 26:
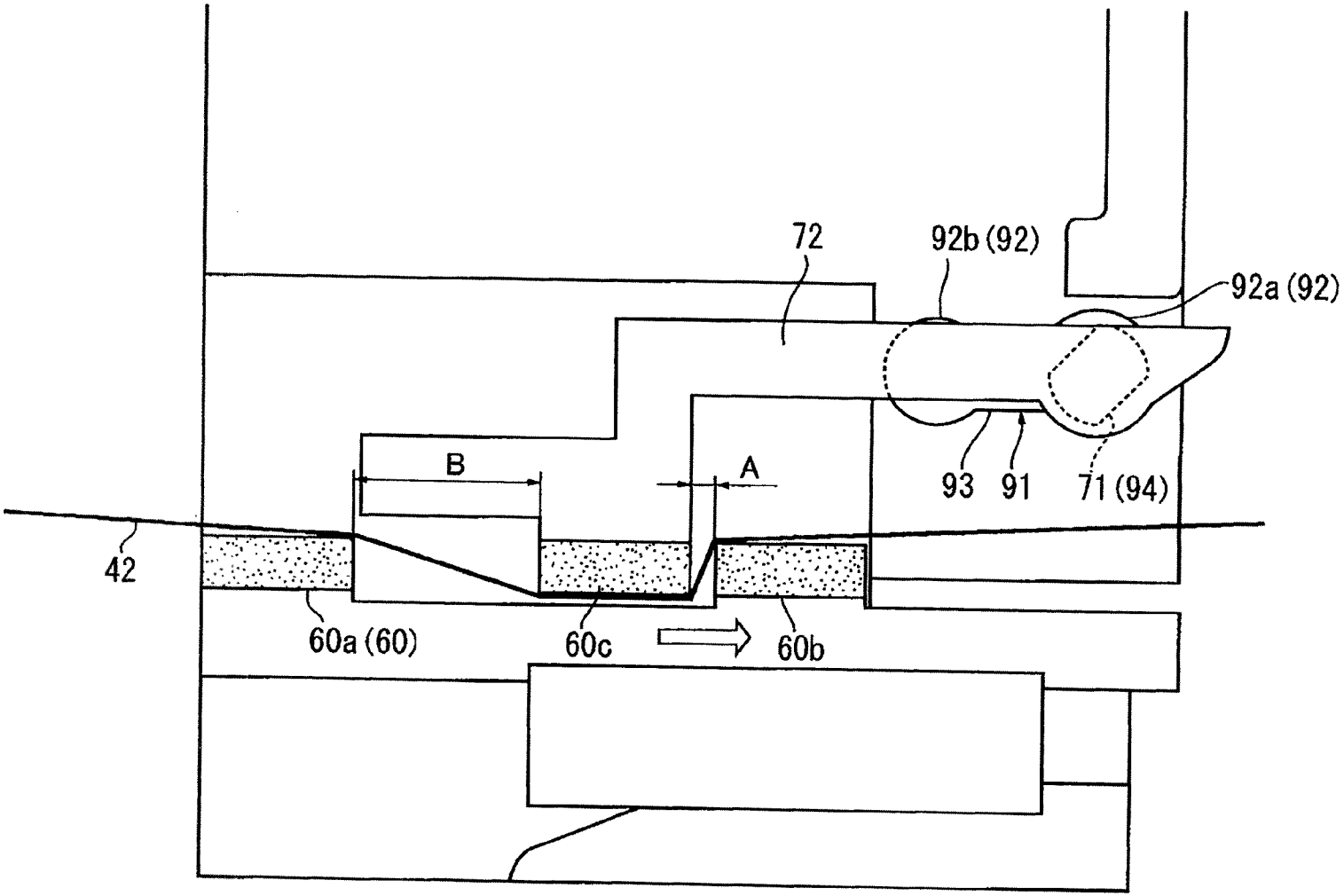
FIG. 26 is an explanatory view showing the disposed position relationship of the cleaning pad when the cleaning device is moved in the return direction.

In this exemplary embodiment, the cleaning position adjustment mechanism 90 variably sets the disposed positions of the cleaning pads so that A<B may be satisfied when all the cleaning pads 60 are brought into contact with the discharge wire 42, assuming that the interval between the bilateral cleaning pad 60*a* located in the movement direction and the intermediate cleaning pad 60*c* along the length direction of the discharge wire 42 is A (see FIGS. 25 and 26) and the interval between the bilateral cleaning pad 60*b* located on the opposite side in the movement direction and the intermediate cleaning pad 60*c* along the length direction of the discharge wire 42 is B (see FIGS. 25 and 26).

In this case, the specific numerical values of A and B may be different, depending on whether the movement direction of the cleaning tool 51 is on the outward path or the return path, but from the viewpoint of homogenizing the cleaning performance of the cleaning tool 51 in the movement direction, the sizes of A and B may be set uniformly, irrespective of the movement direction of the cleaning tool 51.

In this exemplary embodiment, the cleaning position adjustment mechanism 90 is provided with a long hole 91 extending along the movement direction of the cleaning tool 51 on both side walls of the support frame 53 for the movable board 52, for example, and on the other hand, provided with a position change mechanism 100 for regulating the movement range of the swing arm 72 for the wire rod contact/separation mechanism 70 along this long hole 91, and further changing the position of the swing arm 72, when the cleaning tool 51 is located at the initial position of the charging housing 41 and the opposite end to the initial position, as shown in FIGS. 11 to 19.

More specifically, the long hole 91 is formed with one pair of swing bearing portions 92 with which an end portion of the swing shaft 71 for the swing arm 72 may be fitted to be able to swing at both end portions in the longitudinal direction, and a movement slit 93 having a width smaller than the diameter size of the swing bearing portions 92 between the swing bearing portions 92, as shown in FIG. 15. In FIG. 15, reference sign s denotes the central distance between one pair of swing bearing portions 92.

Also, in this exemplary embodiment, an end portion of the swing shaft 71 for the swing arm 72 is configured as a cut shaft 94 having the non-columnar shape. This cut shaft 94 is formed with the cut portions 94*b* parallel to a columnar portion 94*a*, in which the size between the cut portions 94*b* of this cut shaft 94 is set corresponding to the width size of the movement slit 93, as shown in FIG. 15. And when the intermediate cleaning pad 60*c* is located at the cleaning position, the cut shaft 94 is positioned in the swing bearing portions 92 in a state where the cut portions 94*b* of the cut shaft 94 are arranged non-horizontally, while when the intermediate cleaning pad 60*c* is located at the retracted position, the cut shaft 94 may be moved along the movement slit 93 in a state where the cut portions 94*b* of the cut shaft 94 are arranged horizontally.

Further, the position change mechanism 100 is provided with the position change projections 101 and 102 extending toward the suing arm 72 in the movement direction (return direction, outward direction) of the cleaning tool 51, and the position regulation walls 103 and 104 opposed to the position change projections 101 and 102 at both ends of the charging housing 41, as shown in FIGS. 15 to 19.

In particular, in this exemplary embodiment, the position change projections 101 and 102 are arranged to project by the size s1, s2 (see FIGS. 22 and 23) from the support frame 53 of the movable board 52 under the condition that the intermediate cleaning pad 60*c* is at the retracted position, and joined with the position regulation walls 103 and 104 to move the swing arm 72 in the movement range s.

Cleaning Movement Mechanism

Further, the cleaning movement mechanism 110 is formed with an internal thread portion 111 within the drive transmission barrel 56 of the support frame 53 for the movable board 52, and has a ball screw shaft 112 disposed along the longitudinal direction of the charging housing 41, whereby the ball screw shaft 112 is screwed into the internal thread portion 111, and rotated by a drive motor 113 (see FIG. 20) to move the movable board 52 of the cleaning tool 51, as shown in FIGS. 11 to 14.

Figure 20:
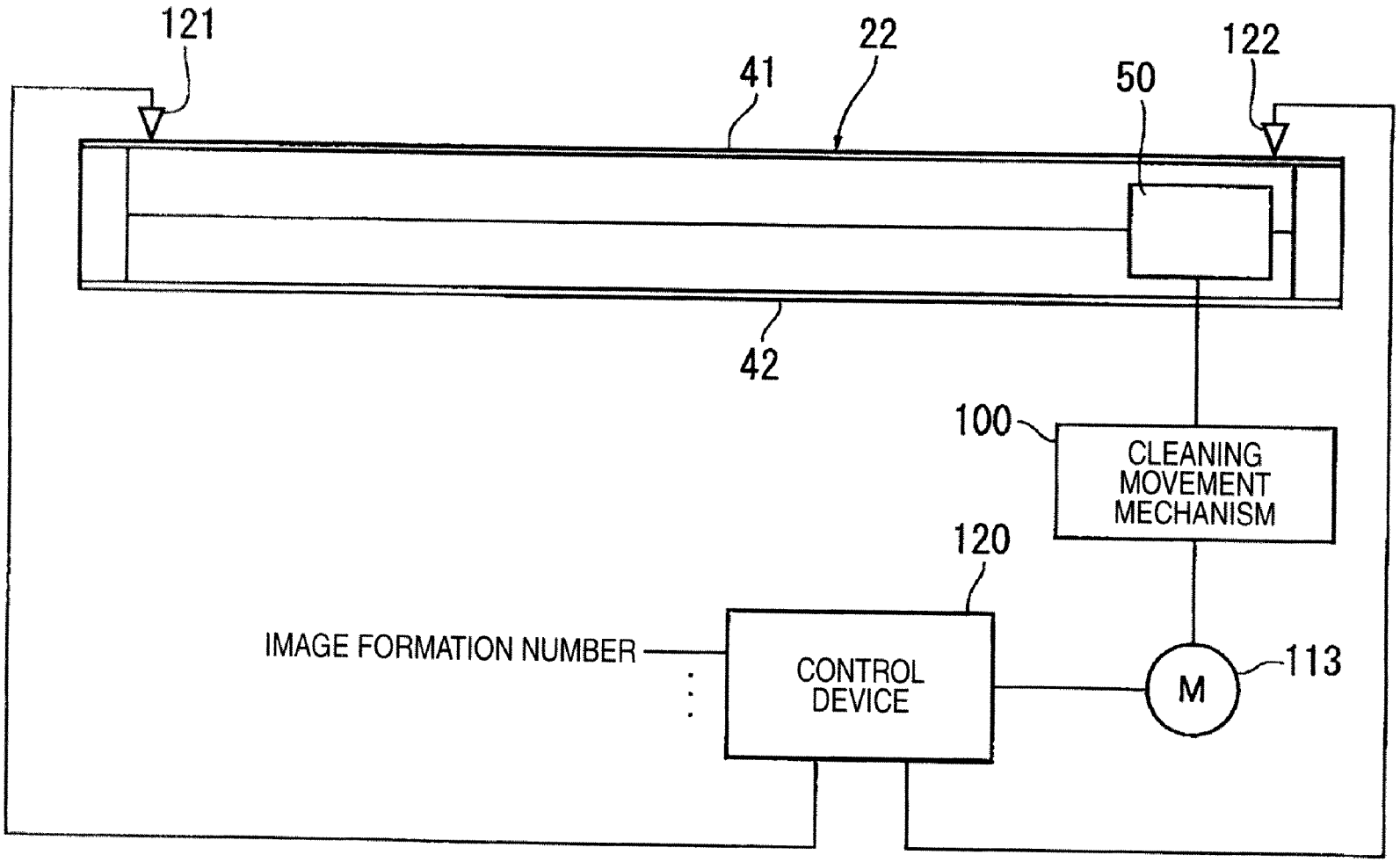
FIG. 20 is an explanatory view showing one example of a control system of the cleaning device for use in the exemplary embodiment 1.

And a control system of the cleaning device 50 has the form as shown in FIG. 20, for example.

In FIG. 20, reference numeral 120 denotes a control device composed of a microcomputer containing a cleaning processing program with the cleaning device 50, for example. Reference numerals 121 and 122 denote a position sensor for detecting that the cleaning tool 51 of the cleaning device 50 arrives at the initial position and the opposite end of the charging housing 41 to the initial position, for example, a limit switch.

Next, the operation of the image firming apparatus according to the invention will be described below mainly about the cleaning device of the charger.

In this exemplary embodiment, the control device 120 counts the image formation number, and performs a cleaning processing program, every time the image formation number reaches a predetermined number, to move the cleaning tool 51 located at the initial position in the outward direction, move the cleaning tool 51 in the return direction based on a detection signal from the position sensor 122 at the stage of reaching the opposite side to the initial position of the charging housing 41, stop moving the cleaning tool 51 based on a detection signal from the position sensor 121 when the cleaning tool 51 returns to the initial position, and reset the image formation number, as shown in FIG. 20.

The execution timing of the cleaning processing program is not limited to the predetermined image formation number, but may be appropriately selected such as every predetermined time cycle, or according to an intentional operation of the user.

In such an operation process, the cleaning device 50 waits in the cleaning wait room, not shown, of the charging housing 41, during non-cleaning. Thus, it is not apprehended that the charging apparatus 50 impairs the charging operation with the charger 22.

Figure 21A:
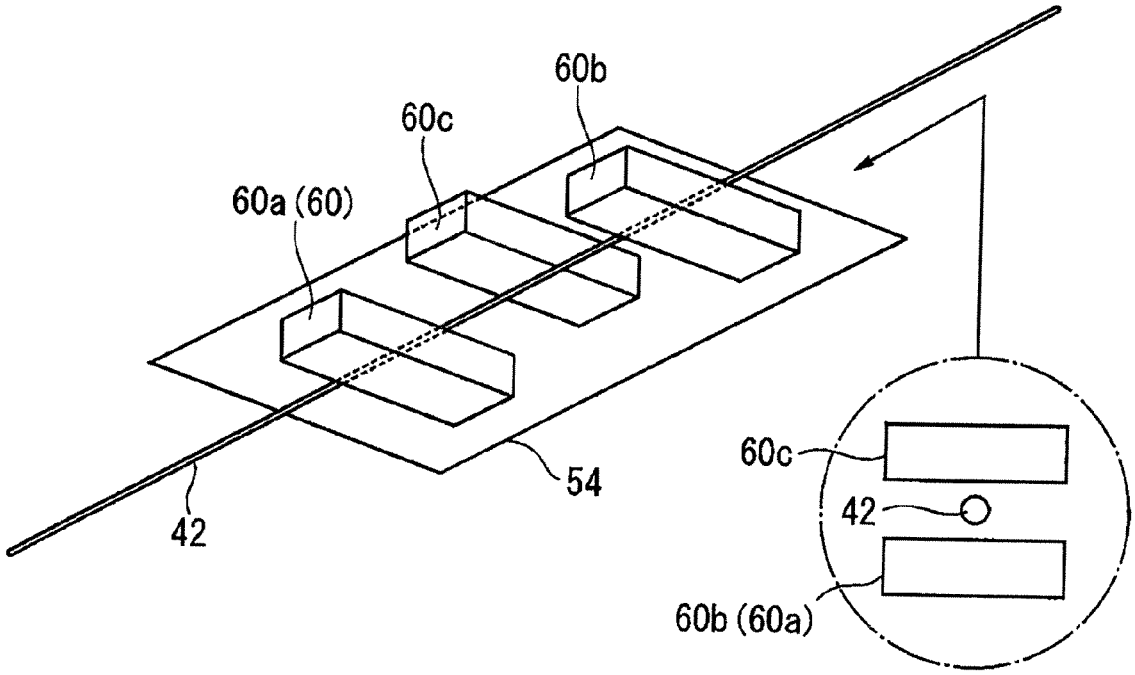
FIG. 21A is an explanatory view showing a state where the cleaning device is not activated.

Also, each cleaning pad 60 (60*a* to 60*c*) of the cleaning device 50 is out of contact with the discharge wire 42 at the initial position, whereby a bite scar by the discharge wire 42 does not remain on the cleaning pad 60, as shown in FIG. 21A.

On the other hand, in executing the cleaning processing program, the cleaning movement mechanism 110 moves the cleaning tool 51 from the initial position in the outward direction, based on a control signal from the control device 120.

Figure 21B:
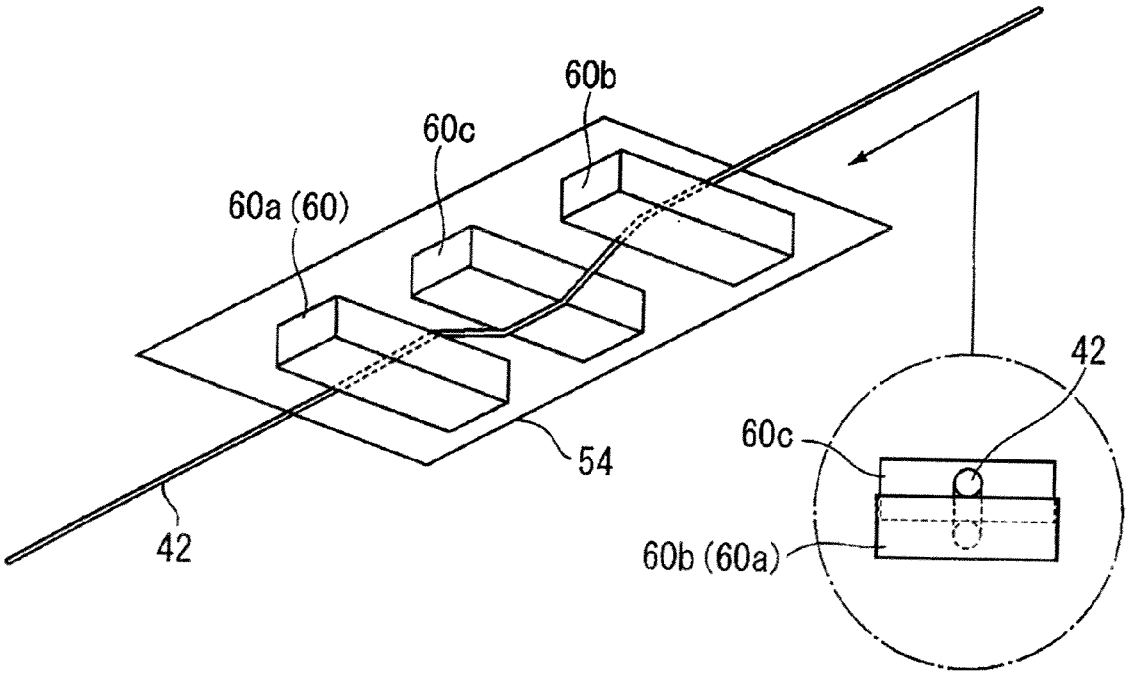
FIG. 21B is an explanatory view showing a state where the cleaning device is activated.

Then, the intermediate cleaning pad 60*c* of the cleaning device 50 is moved to the cleaning position, and accordingly the bilateral cleaning pads 60*a* and 60*b* and the intermediate cleaning pad 60*c* are placed in contact with the discharge wire 42 and moved with the discharge wire 42 sandwiched, as shown in FIG. 21B.

At this time, the bilateral cleaning pads 60*a* and 60*b* are moved to wipe off the discharge wire 42 on the side of the photoconductor 21 and the intermediate cleaning pad 60*c* is moved to wipe off its opposite side, securely cleaning out the discharge product adhering to the side of the photoconductor 21 among the discharge product adhering to the discharge wire 42. Thus, the cleanliness of the discharge wire 42 may be kept excellent.

Since the discharge wire 42 is cleaned by three cleaning pads 60 (60*a* to 60*c*), the cleaning area is wider than the case of using two cleaning pads, for example. Then, the cleaning performance with the cleaning tool 51 may be accordingly enhanced.

In this case, when the bite amount of the intermediate cleaning pad 60*c* is set to be smaller, for example, the wiping performance of the cleaning pad 60 is weakened. However, since the cleaning area with the cleaning tool 51 is expanded, the cleaning ability of the cleaning tool 51 may be easily set in the proper range by adjusting both.

Further, in this exemplary embodiment, if the cleaning tool 51 arrives at the end portion opposite to the initial position of the charging housing 41, the cleaning movement mechanism 110 cleans the discharge wire 42, while moving the cleaning tool 51 in the return direction, in accordance with a control signal from the control device 120.

At this time, since the cleaning power with the cleaning tool 51 is almost equivalent in the outward direction and the return direction of the cleaning tool 5l, as described above in FIGS. 2 and 3, the cleaning property with the cleaning tool 51 acts almost invariably, irrespective of the movement direction of the cleaning tool 51.

Further, in this exemplary embodiment, since the movable board 52 is provided with the cleaning receiving member 54 in the support frame 53, the discharging product wiped off the discharge wire 42 by the cleaning pad 60 is received by the cleaning receiving member 54, when falling down, whereby it is not apprehended that the discharging product falls down on the lattice electrode 43 or photoconductor 21, having adverse influence on the charging performance of the charger 22 or the formation of latent image on the photoconductor 21.

Further, in this exemplary embodiment, if the cleaning tool 51 arrives at the end portion opposite to the initial position of the charging housing 41, the movement direction of the cleaning tool 51 is switched to the return direction in a state where the cleaning pads 60 (60*a* to 60*c*) are once separated away from the discharge wire 42, and the cleaning pad 60 is placed in contact with the discharge wire 42 again.

Therefore, in this exemplary embodiment, when the cleaning tool 51 is switched from the outward direction to the return direction the discharge wire 42 does not locally bite the cleaning pad 60, so that the life of the cleaning pad 60 may be extended accordingly.

In particular, in this exemplary embodiment, since the cleaning position adjustment mechanism 90 operates in addition to the wire rod contact/separation mechanism 70, the cleaning performance with the cleaning pads 60 (60*a* to 60*c*) is made more efficient.

In this exemplary embodiment, in the cleaning device 50, when the cleaning tool 51 is moved in the outward direction, the disposed position of each cleaning pad 60 (60*a* to 60*c*) is adjusted so that the relationship A<B may be satisfied, for the interval A between the bilateral cleaning member 60*a* located in the movement direction and the intermediate cleaning member 60*c* and the interval B between the bilateral cleaning member 60*b* located on the opposite side in the movement direction and the intermediate cleaning member 60*c*, as shown in FIG. 25.

On the other hand, in the cleaning device 50, when the cleaning tool 51 is moved in the return direction, the disposed position of each cleaning pad 60 (60*a* to 60*c*) is adjusted so that the relationship A<B may be satisfied, for the interval A between the bilateral cleaning member 60*b* located in the movement direction and the intermediate cleaning member 60*c* and the interval B between the bilateral cleaning member 60*a* located on the opposite side in the movement direction and the intermediate cleaning member 60*c*, as shown in FIG. 26.

Therefore, there is a difference in the pressure on the contact surface between each cleaning pad 60 (60*a* to 60*c*) and the discharge wire 42, whether the cleaning tool 51 is in the outward direction or the return direction. More specifically, the contact pressure between the bilateral cleaning pad 60*a* or 60*b* located in the movement direction and the discharge wire 42 is set to be larger than the contact pressure between the bilateral cleaning pad 60*b* or 60*a* located on the opposite side in the movement direction and the discharge wire 42. Further, the contact pressure between the intermediate cleaning pad 60*c* located in the movement direction and the discharge wire 42 is set to be larger than the contact pressure between the intermediate cleaning pad 60*c* located on the opposite side in the movement direction and the discharge wire 42.

Therefore, the dirt of the charging wire rod 11 is scraped out in the part of the cleaning pad 60 (60*a* or 60*b*, 60*c*) having larger contact pressure, and the scraped dirt is wiped off in the part of the cleaning pad 60 (60*b* or 60*a*, 60*c*) having smaller contact pressure. Thus, the dirt having strong adherence to the discharge wire 42 may be effectively cleaned out.

Next, the adjustment of the disposed position of each cleaning pad 60 will be described below.

Now, assume that the cleaning tool 51 is moved in the return direction and arrives near the initial position, as shown in FIG. 18.

At this time, the s wing shaft 71 (corresponding to the cut shaft 94) of the swing arm 72 is fitted with one swing bearing portions 92 (specifically 92*a*) of the long hole 91 in the cleaning position adjustment mechanism 90, as shown in FIG. 26.

In this state, if the cleaning tool 51 is moved toward the initial position, the retracting projection 85 is joined with the incline guide plane 81 of the swing arm 72 in the intermediate cleaning pad 60*c*, and changed from the state as indicated by the imaginary line to the state as indicated by the solid line in FIG. 18, so that the intermediate cleaning pad 60*c* is moved to the retracted position at the position where the retracting projection 85 gets over the hook step portion 83 of the inclined guide plane 81, as shown in FIG. 18.

At this time, the cut portion 94*b* of the cut shaft 94 that is the swing shaft 71 is arranged horizontally along with an attitude change of the swing arm 72, and ready to be movable into the movement slit 93 of the long hole 91.

Thereafter, if the cleaning tool 51 is further moved to the initial position, a position change projection 101 of a position change mechanism 100 arrives at a position regulation wall 103, as shown in FIG. 18.

Figure 22:
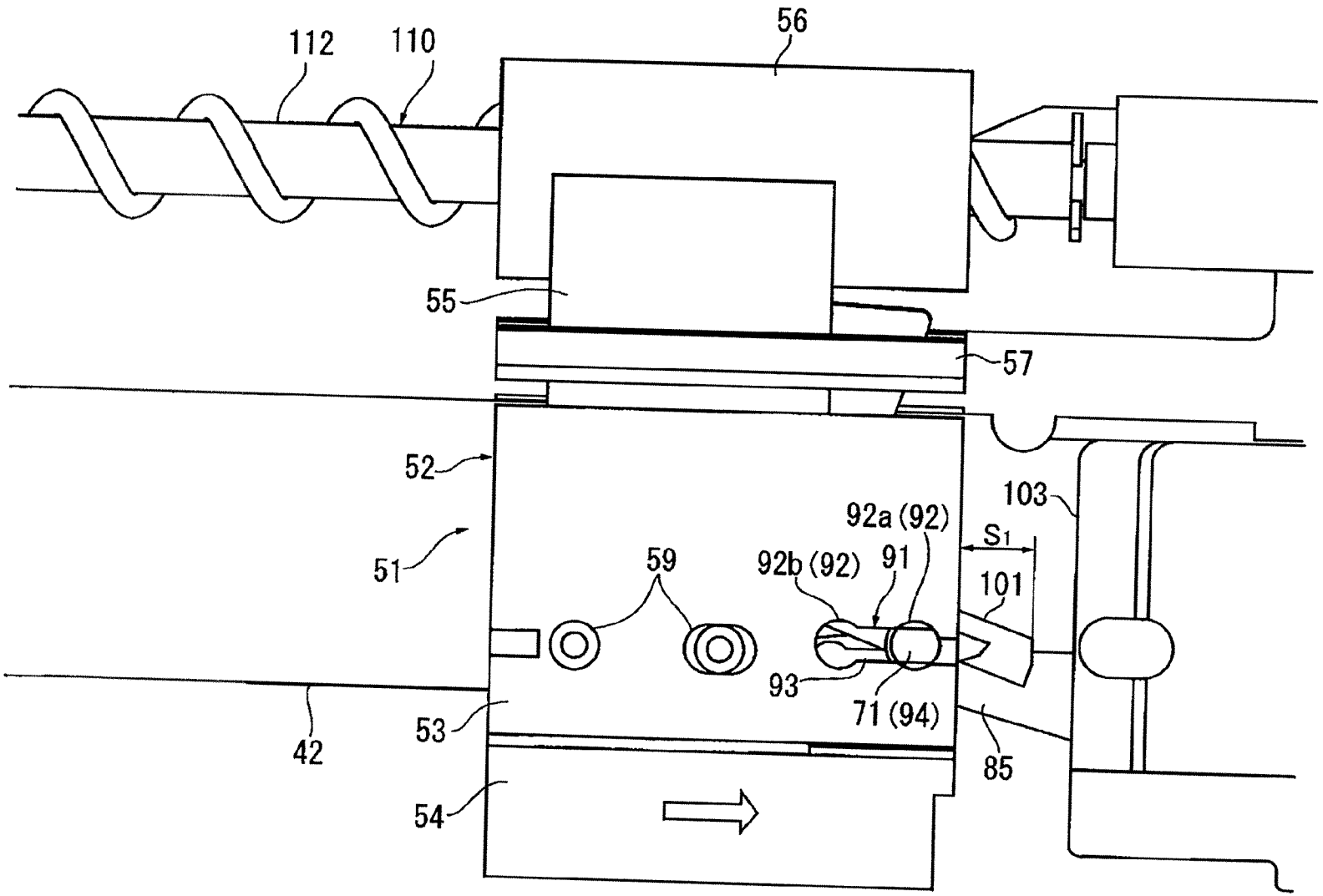
FIG. 22 is an explanatory view showing an operation process of the cleaning position adjustment mechanism immediately before the cleaning device returns to the initial position.
Figure 23:
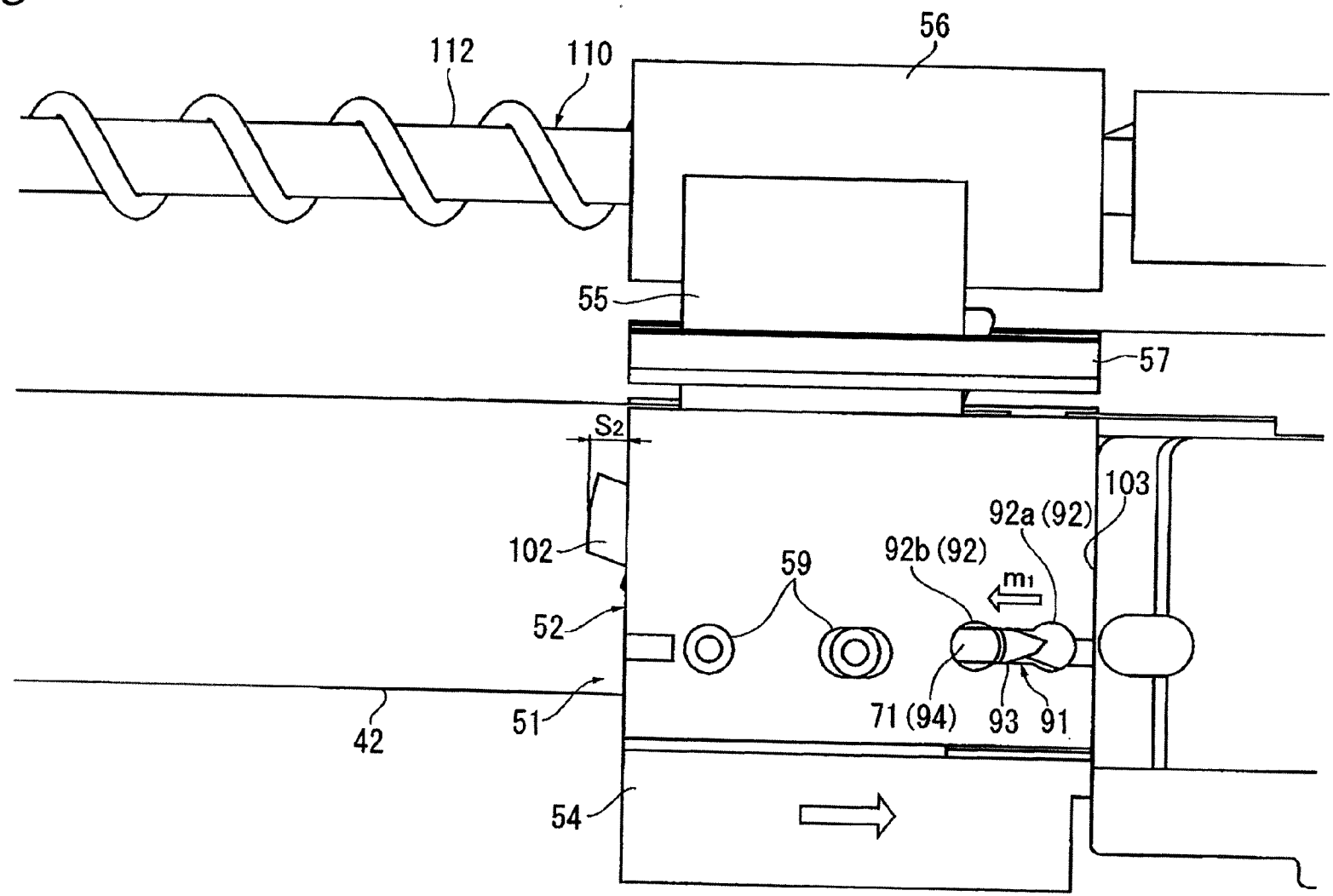
FIG. 23 is an explanatory view showing an operation process of the cleaning position adjustment mechanism when the cleaning device arrives at the initial position.

At this stage, if the cleaning tool 51 is further moved, the swing arm 72 is moved in the direction as indicated by the arrow $m_1$ in FIG. 23, until an end portion of the movable board 52 arrives at the position regulation wall 103, for example, so that the swing shaft 71 of the swing arm 72 is positioned at the other swing bearing portions 92 (specifically 92*b*) of the long hole 91, as shown in FIGS. 22 and 23.

Thereafter, if the cleaning tool 51 starts to be moved in the outward direction, the swing arm 72 is returned from the inclined attitude to the almost horizontal attitude, because the position constraint of the swing arm 72 with the retraction mechanism 80 of the wire rod contact/separation mechanism 70 is released, so that the intermediate cleaning pad 60*c* is set from the retracted position to the cleaning position.

In this state, the swing shaft 71 (corresponding to the cut shaft 94) of the swing arm 72 is positioned at the other swing hearing portions 92 (92*b*) of the long hole 91, because the cut portion 94*b* is inclined.

Figure 24:
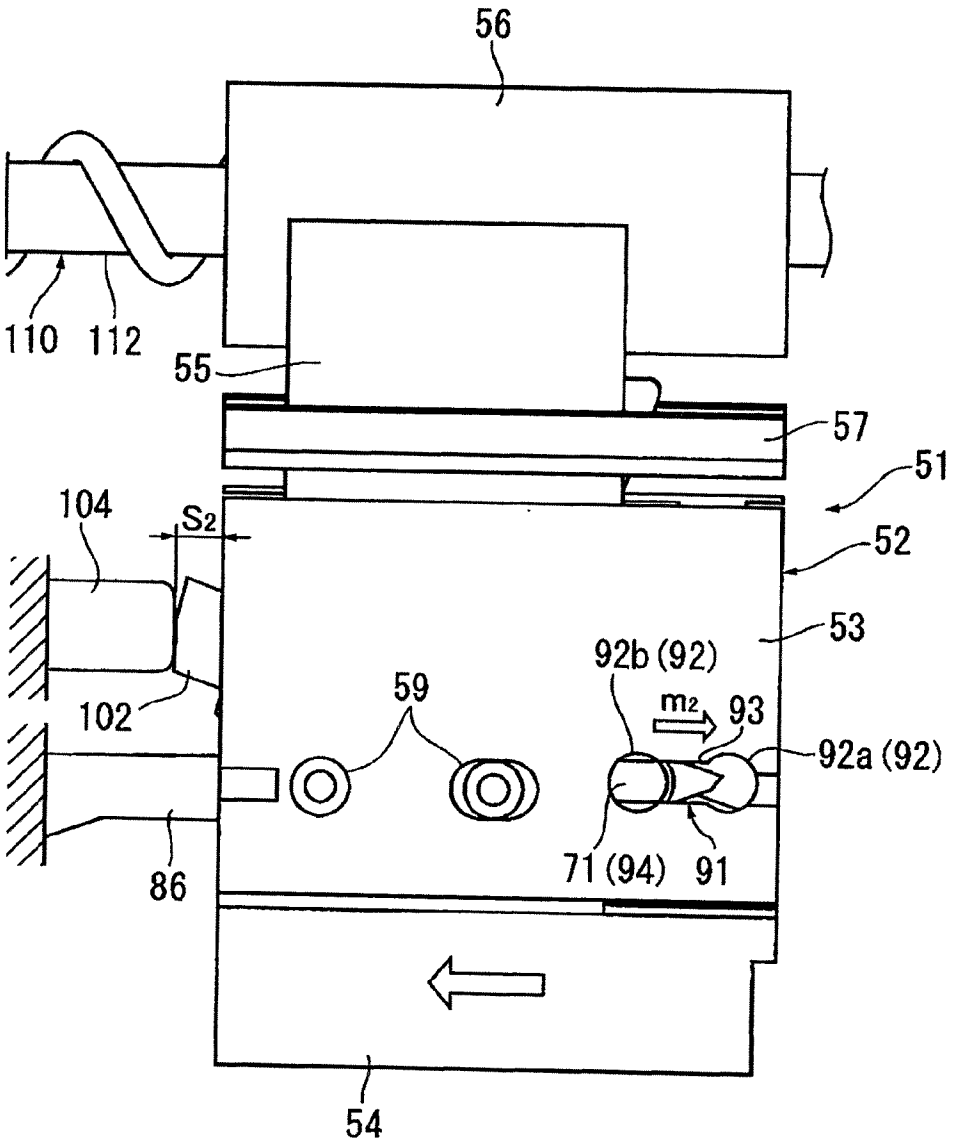
FIG. 24 is an explanatory view showing an operation process of the cleaning position adjustment mechanism when the cleaning device arrives at an end of the charging housing opposite to the initial position.

And if the cleaning tool 51 arrives at the end portion opposite to the initial position of the charging housing 41, the intermediate cleaning pad 60*c* is moved from the cleaning position to the retracted position by the retraction mechanism 80 (inclined guide plane 82, hook step portion 83, retracting projection 86) of the wire rod contact/separation mechanism 70, as shown in FIG. 24.

At this time, the cut portion 94*b* of the cut shaft 94 that is the swing shaft 71 is arranged horizontally along with an attitude change of the swing arm 72, and ready to he movable into the movement slit 93 of the long hole 91.

Further, in this exemplary embodiment, the position change mechanism 100 (position change projection 102, position regulation wall 104) of the cleaning position adjustment mechanism 90 moves the disposed position of the swing arm 72 in the intermediate cleaning pad 60*c* retracted to the retracted position in the direction as indicated by the arrow $m_2$ in FIG. 24, and moves and sets the swing shaft 71 of the swing arm 72 to one swing bearing portions 92 (specifically 92*b*) of the long hole 91.

Thereafter, if the cleaning tool 51 starts to be moved in the return direction, the swing arm 72 is returned from the inclined attitude to the almost horizontal attitude, because the position constraint of the swing arm 72 with the retraction mechanism 80 of the wire rod contact/separation mechanism 70 is released, so that the intermediate cleaning pad 60*c* is set from the retracted position to the cleaning position.

In this state, the swing shaft 71 (corresponding to the cut shaft 94) of the swing arm 72 is positioned at the one swing bearing portions 92 (92*b*) of the long hole 91, because the cut portion 94*b* is inclined.

Exemplary Embodiment 2

Figure 27A:
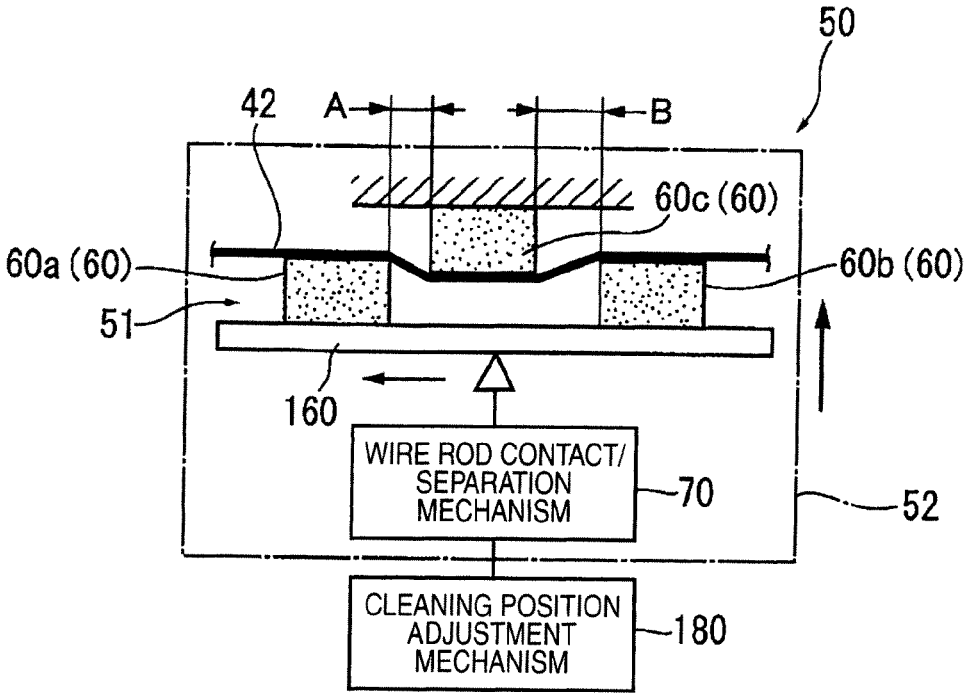
FIG. 27A is an explanatory front view showing a state during cleaning of the cleaning device for use in an exemplary embodiment 2.
Figure 27B:
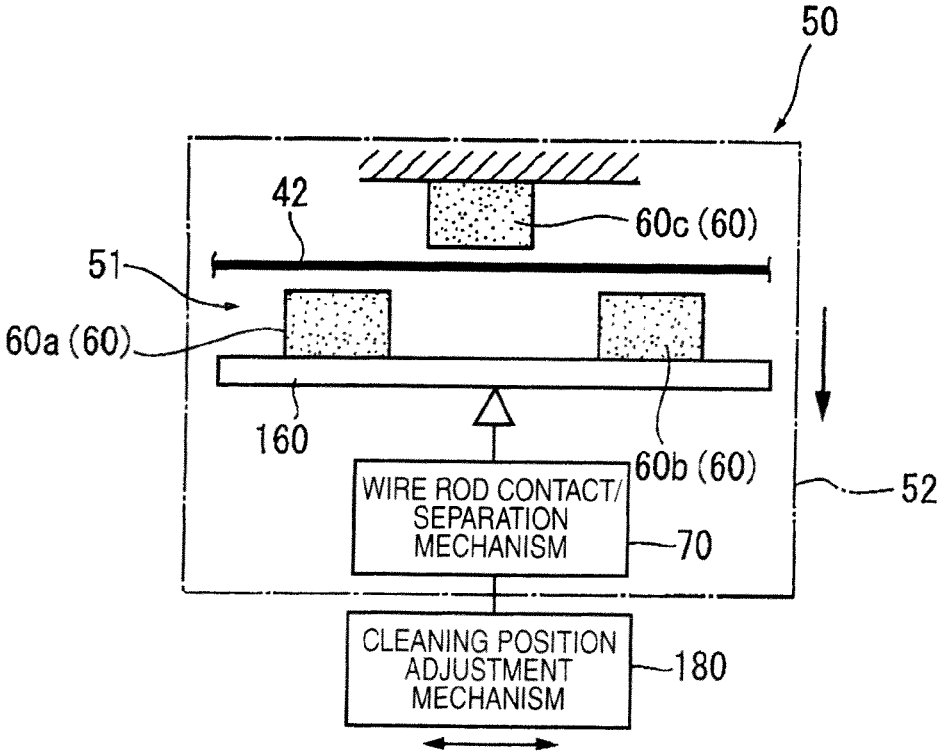
FIG. 27B is an explanatory front view showing a state during non-cleaning of the cleaning device.

FIGS. 27A and 27B show the outline of an exemplary embodiment 2 of the cleaning device for use in the charger to which the invention is applied.

In FIG. 27, the cleaning device 50, like the exemplary embodiment 1, includes three cleaning pads 60 (60*a* to 60*c*) movable together with the movable board 52 and spaced along the length direction of the discharge wire 42, as the cleaning tool 51 for cleaning the discharge wire 42, but unlike the exemplary embodiment 1, includes one pair of bilateral cleaning pads 60*a* and 60*b* disposed via the wire rod contact/separation mechanism 70 on the side of the photoconductor 21 in the discharge wire 42 within the movable board 52, and the intermediate cleaning pad 60*c* fixedly disposed on the other side in the direction across the discharge wire 42 and almost in the center of the bilateral cleaning pads 60*a* and 60*b* in the length direction of the discharge wire 42.

Herein, the basic constitution of the movable board 52, almost like the exemplary embodiment 1, has the support frame 53 slidable along the longitudinal direction of the charging housing 41, in which the cleaning receiving member 54 covering the lower side of each cleaning pad 60 (60*a* to 60*c*) is provided in this support frame 53. The same parts are designated by the same reference numerals as in the exemplary embodiment 1, and the detailed explanation thereof is omitted.

Figure 28:
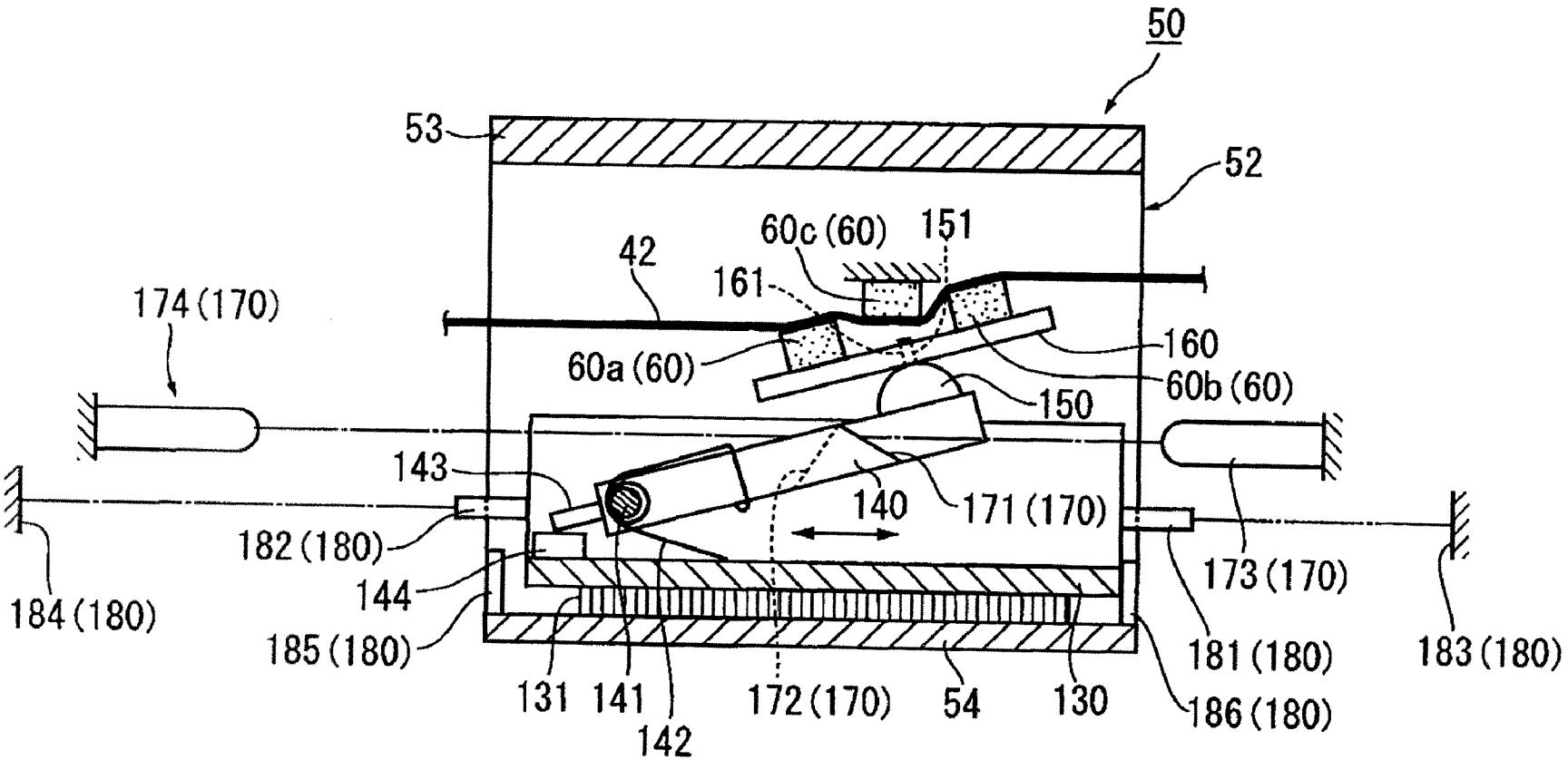
FIG. 28 is an explanatory view showing a constitution example of the cleaning device for use in the exemplary embodiment 2.

In this exemplary embodiment, the cleaning receiving member 54 is provided with a movable table 130 movable along the movement direction of the cleaning tool 51 to be slidable on a guide rail 131, and the bilateral cleaning pads 60*a* and 60*b* are provided on the movable table 130 to be freely contacted with or separated away from the discharge wire 42 by the wire rod contact/separation mechanism 70, as shown in FIGS. 27A, 27B and 28.

In this exemplary embodiment, the wire rod contact/separation mechanism 70 supports rotatably a rotation support shaft 141 provided at one end of the swing arm 140 on both side walls of the cleaning receiving member 54, in which a biasing spring 142 is wound around the rotation support shaft 141 of this swing arm 140, and biases the swing arm 140 in a push-up direction away from the bottom wall of the cleaning receiving member 54, as particularly shown in FIGS. 27 and 28. A position regulation piece 143 is protruded closer to the rotation support shaft 141 of the swing arm 140, and when this position regulation piece 143 directly contacts a stopper 144, the position regulation piece 143 regulates the push-up position of the swing arm 140.

Further, in this exemplar embodiment, a support board 150, semi-circular in cross section, for example, is provided on the surface of the swing arm 140 at the free end of swing, and a swinging support plate 160 is provided to be freely slidable on the support board 150.

An swing support structure of this swing support plate 160 is that a plurality of (two in this exemplary embodiment) support pins 151 are provided on the top of the support board 150, and a plurality of (two in this exemplary embodiment) support holes 161 into which the support pins 151 are fitted are opened in the swing support plate 160, the support pins 151 being fitted into the support holes 161, for example.

Figure 29:
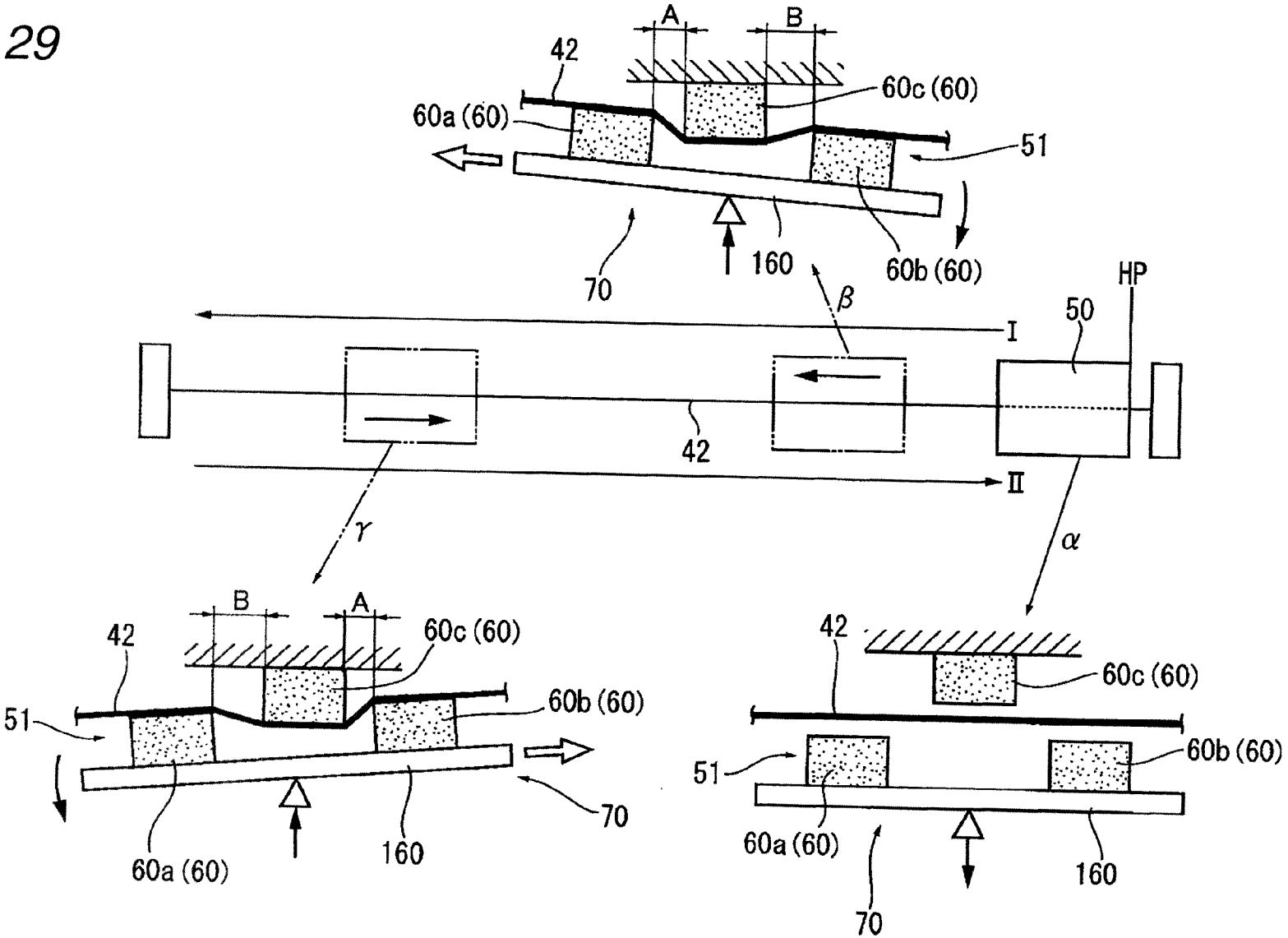
FIG. 29 is an explanatory view showing an operating state of the cleaning device for use in the exemplary embodiment 2.

Also, in this exemplary embodiment, the wire rod contact/separation mechanism 70 includes a retraction mechanism 170 with which the bilateral cleaning pads 60*a* and 60*b* are separated away from the discharge wire 42 and moved to the retracted position, when the cleaning device 50 is located at the initial position HP (see FIG. 29).

This retraction mechanism 170 is formed with the inclined guide planes 171 and 172 in the parts of the swing arm 140, the retracting projections 173 and 174 are provided in the regions opposed to the inclined guide planes 171 and 172, the retracting projection 173 or 174 is joined with the inclined guide plane 171 or 172, and the swing arm 140 is pushed up against the biasing direction of the biasing spring 142.

Also, in this exemplary embodiment, a cleaning position adjustment mechanism 180 for adjusting the disposed position of the bilateral cleaning pads 60*a* and 60*b* according to the movement direction of the cleaning tool 51 is provided.

This cleaning position adjustment mechanism 180 variably sets the disposed position of the cleaning pad 60 (60*a* to 60*c*) so that A<B may be satisfied when all the cleaning pads 60 are brought into contact with the discharge wire 42, assuming that the interval between the bilateral cleaning pad 60*a* located in the movement direction and the intermediate cleaning pad 60*c* along the length direction of the discharge wire 42 is A and the interval between the bilateral cleaning pad 60*b* located on the opposite side in the movement direction and the intermediate cleaning pad 60*c* along the length direction of the discharge wire 42 is B (see FIGS. 27 and 29).

In this exemplary embodiment, the cleaning position adjustment mechanism 180 is provided with the position change projections 181 and 182 at both ends of the movable table 130 in the movement direction, and the position regulation walls 183 and 184 opposed to the position change projections 181 and 182 at both ends of the charging housing 41 in the longitudinal direction, as shown in FIG. 28.

In this exemplary embodiment, the position change projections 181 and 182 are protruded out of the support frame 53 of the movable board 52, and the movable table 130 is movable in a predetermined movement range via the position change projections 181 and 182 until both ends of the movable board 52 make contact with the position regulation walls 183 and 184. Reference numerals 185 and 186 denote a stopper for regulating the movement range of the movable table 130.

The operation of the cleaning device according to this exemplary embodiment will be described below.

Now assuming that the cleaning device 50 is located at the initial position HP as shown in FIG. 29α, the wire rod contact/separation mechanism 70 allows the retraction mechanism 170 (inclined guide plane 171) to move the bilateral cleaning pads 60*a* and 60*b* to the retracted position away from the discharge wire 42.

Also, the cleaning position adjustment mechanism 180 adjusts the disposed positions of the cleaning pads 60 (60*a* to 60*c*) at the initial position HP so that A<B may be satisfied.

In this exemplary embodiment, the cleaning device 50 located at the initial position HP cleans the discharge wire 42 periodically, for example, at the same timing as in the exemplary embodiment 1.

That is, the cleaning movement mechanism (see the cleaning movement mechanism 110 of the exemplary embodiment 1), not shown, repeats a cycle of moving the cleaning device 50 from the initial position HP in the outward direction (I direction), and moving it in the return direction (II direction) a predetermined number of times, based on a control signal from the control device, not shown, and then returns to the initial position HP.

At this time, if the cleaning device 50 is moved from the initial position HP in the outward direction, a retracted state of the cleaning device to the retracted position by the retraction mechanism 170 is released, the bilateral cleaning pads 60*a* and 60*b* are moved to the cleaning position with a push-up operation of the swing arm 140 in the wire rod contact/separation mechanism 70, and accordingly the bilateral cleaning pads 60*a* and 60*b* and the intermediate cleaning pad 60*c* are placed in contact with the discharge wire 42, and moved with the discharge wire 42 sandwiched.

In this state, the bilateral cleaning pads 60*a* and 60*b* wipe off on the side of the photoconductor 21 the discharge wire 42 and the intermediate cleaning pad 60*c* wipes off its opposite side.

In particular, in this exemplary embodiment, since the bilateral cleaning pads 60*a* and 60*b* may be freely swung around the swing center position as the swing fulcrum on the swing support plate 160, the bilateral cleaning pads 60*a* and 60*b* clean the discharge wire 42 in an obliquely upwardly inclined attitude toward the outward direction, following the inclined attitude of the discharge wire 42, when the cleaning device 50 is moved in the outward direction, as shown in FIG. 29β.

In this state, even when the bite amount of the bilateral cleaning pads 60*a* and 60*b* into the discharge wire 42 are set to be smaller, the cleaning property with each cleaning pad 60 is secured excellently. Therefore, even if the discharge wire 42 is reduced in diameter, the bite pressure (pushing pressure) of each cleaning pad 60 into the discharge wire 42 may be reduced, thereby achieving the longer life of the cleaning pads 60.

Since the disposed positions of the cleaning pads 60 (60*a* to 60*c*) satisfy the relationship A<B, the efficient cleaning performance may be realized by separating the functions into a dirt scraping action and a dirt wiping action, as in the exemplary embodiment 1.

If the cleaning device 50 is moved to the terminal in the outward direction, it starts to he moved in the return direction, as shown in FIG. 29.

At this time, the cleaning position adjustment mechanism 180 adjusts the disposed positions of the cleaning pads 60 (60*a* to 60*c*) so that A<B may be satisfied.

And since the bilateral cleaning pads 60*a* and 60*b* may be freely swung around the swing center position as the suing fulcrum on the swing support plate 160, the bilateral cleaning pads 60*a* and 60*b* clean the discharge wire 42 in an obliquely upwardly inclined attitude toward the return direction, following the inclined attitude of the discharge wire 42, when the cleaning device 50 is moved in the return direction, as shown in FIG. 29γ.

Therefore, the cleaning property with the cleaning pads 60 (60*a* to 60*c*) is kept excellent in the same way as in the outward direction.

EXAMPLES

Example 1

Figure 30:
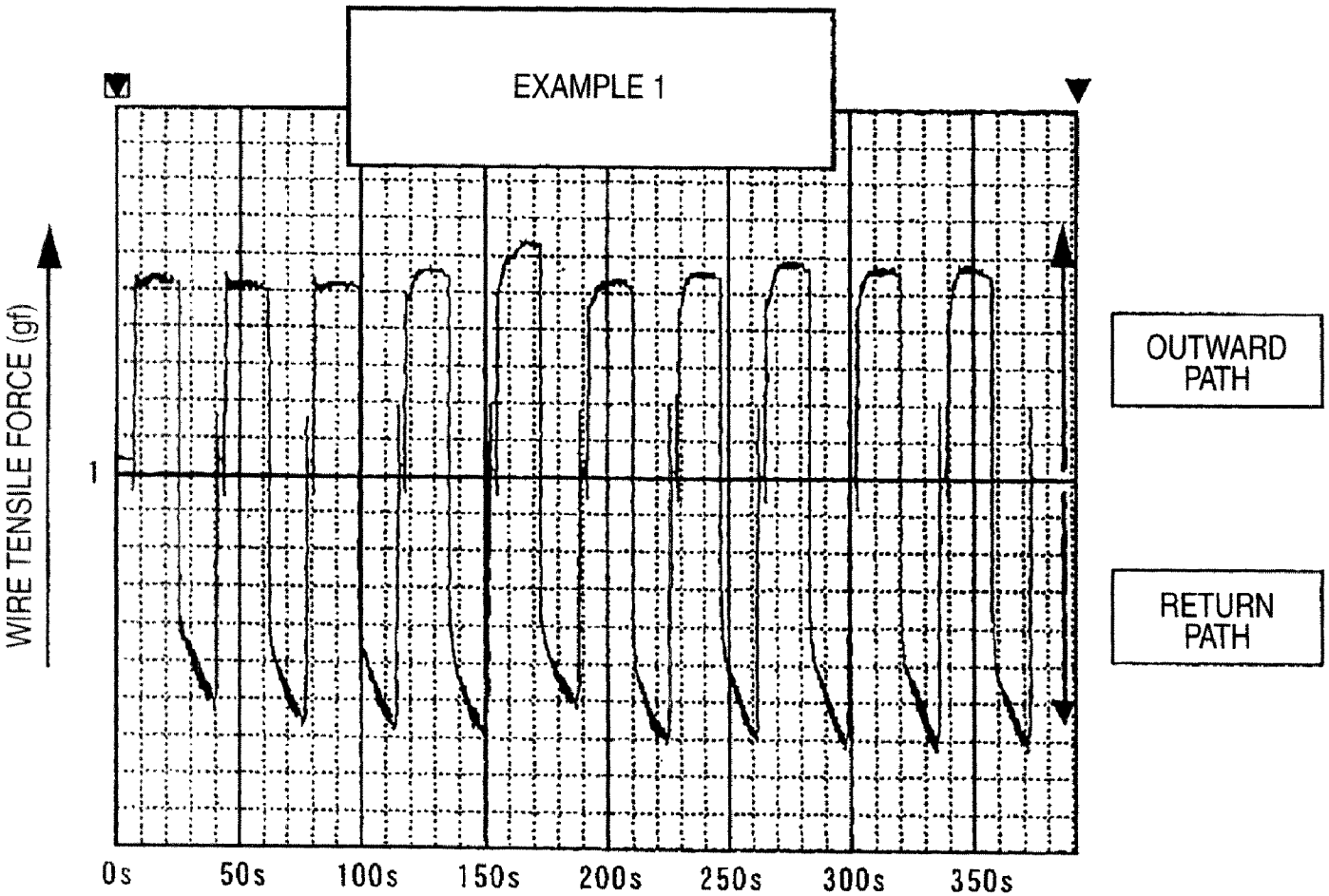
FIG. 30 is an explanatory view showing the change of wire tensile force on the outward path and return path in using the cleaning device in an example 1.

An example 1 is the cleaning device 50 for the charger 22 for use in the exemplary embodiment 1. The wire tensile force in moving the cleaning tool 51 in the outward direction and return direction is measured, whereby the results are obtained as shown in FIG. 30. In this example and following examples, the disposed position of the cleaning pad is A=B, and the performance of the form in which three cleaning pads are arranged in symmetry is investigated.

The performing conditions of FIG. 30 are as follows.

Discharge wire Material: tungsten wire Wire diameter: 40 μm

Figure 31:
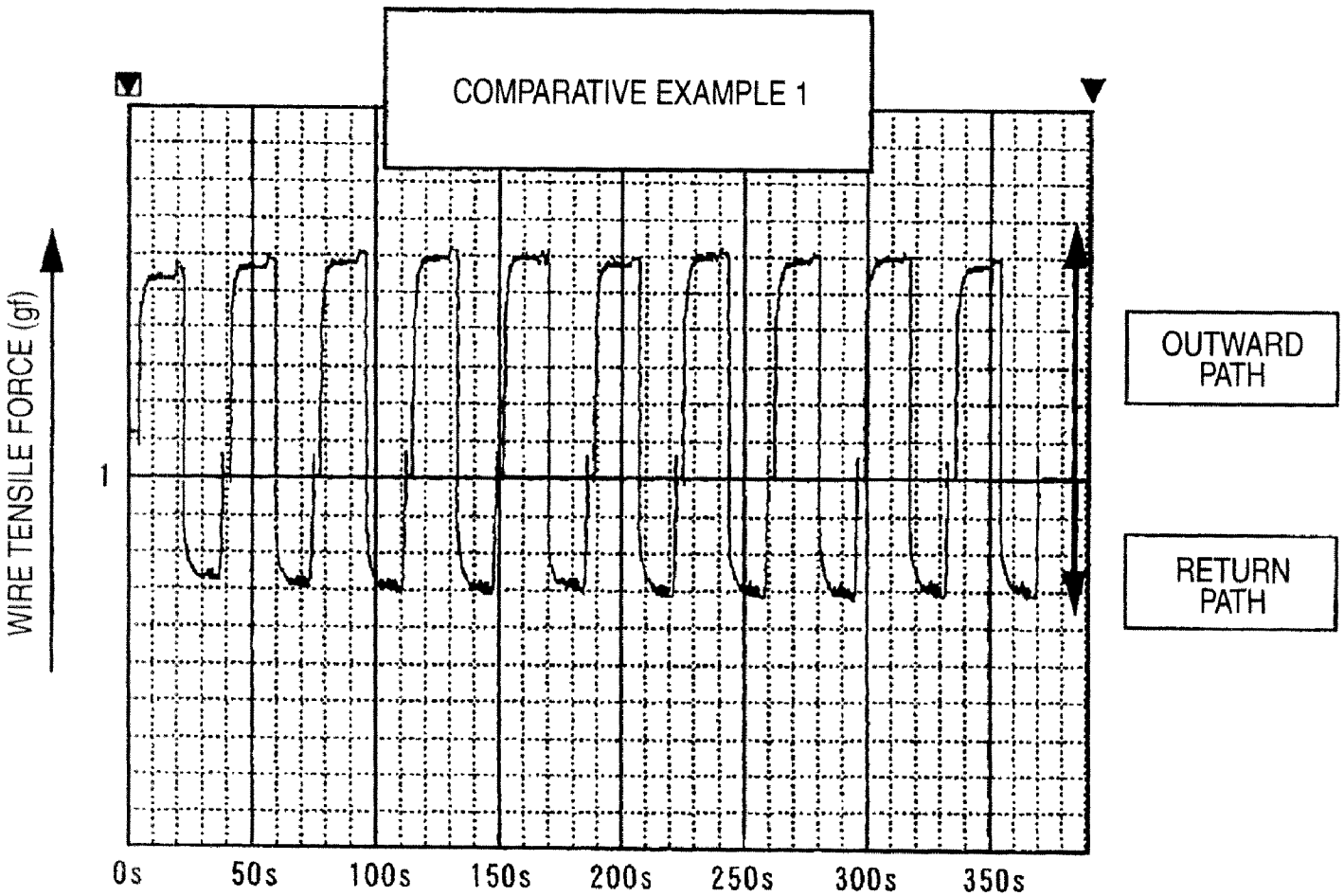
FIG. 31 is an explanatory view showing the change of wire tensile force on the outward path and return path in using the cleaning device in a comparative example 1.

Cleaning pad (see FIG. 10A) Width size w: 4 mm Thickness h: 1 mm Spacing d: 1 mm Bite amount k: 1 mm Moving speed in outward direction and return direction: 21.5 mm/sec Also, a comparative example 1 is performed using two cleaning pads 60*a* and 60*c* (with the same constitution as the example 1) by removing the cleaning pad 60*b* of the example 1 under the following conditions, whereby the results are obtained as shown in FIG. 31.

The performing conditions of FIG. 31 are as follows.

Discharge wire Material: tungsten wire Wire diameter: 40 μm Width size w: 4 mm Thickness h: 1 mm Spacing d: 1 mm Bite amount k: 1.6 mm Moving speed in outward direction and return direction: 21.5 mm/sec In FIG. 30, it may be found that the wire tensile force is substantially equal, irrespective of the movement direction of the cleaning tool 51 in the example 1.

On the contrary, in FIG. 31, the wire tensile force is different depending on the movement direction of the cleaning tool, and particularly, the wire tensile force is smaller in the return direction than the outward direction, whereby it is apprehended that the cleaning power with the cleaning tool is less sufficient in the comparative example 1.

Example 2

An example 2 is the cleaning device 50 for the charger 22 for use in the exemplary embodiment 1. The relationship between the bite amount/pad spacing (k/d) and the wire tensile force is investigated. The performing conditions of the example 2 are the almost same as those of the example 1, and the same test as in the example 2 is performed using a comparative example 2 with the same configuration as the comparative example 1.

Figure 32:
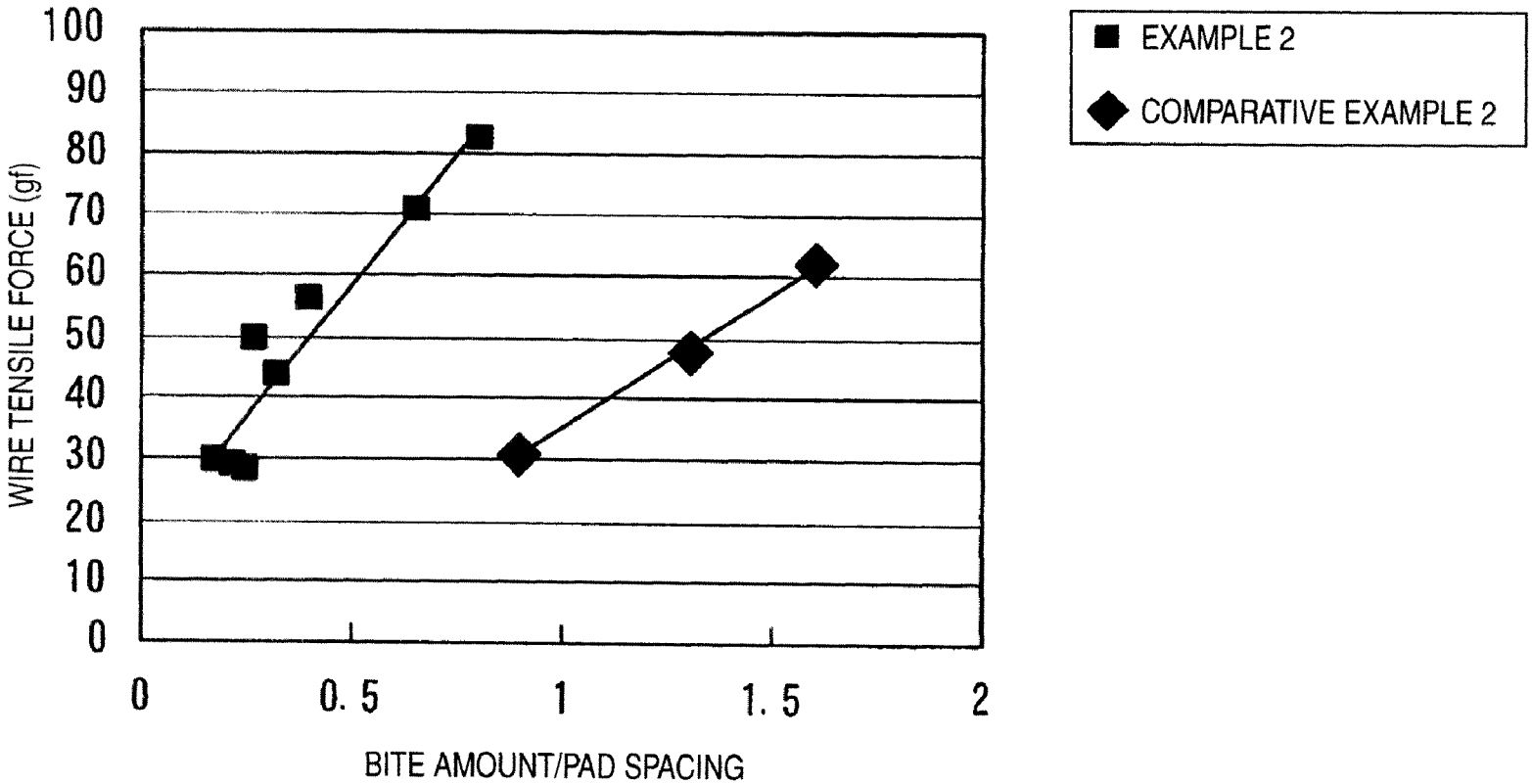
FIG. 32 is an explanatory view showing the relationship between the bite amount/pad spacing and the wire tensile force in an example 2 and a comparative example 2.

The results are shown in FIG. 32.

In FIG. 32, in the example 2, if k/d is in the range from 0.2 to 0.7, the wire tensile force is from 30 to 80 gf (0.29 to 0.78N). Thus, it is confirmed that the cleaning performance with the cleaning tool 51 is kept excellent.

Besides the example 2, the same test as the example 2 is performed using other material, whereby there is the almost same tendency as in FIG. 32.

On the other hand, in the comparative example 2, if k/d is increased to 0.9 or more, the wire tensile force is from 30 to 60 gf (0.29 to 0.59N). Thus, it is more difficult on the design to increase the bite amount or reduce the spacing between the cleaning pads to obtain the wire tensile force sufficient for cleaning.

Example 3

An example 3 is the cleaning device 50 for the charger 22 for use in the exemplary embodiment 1. The relationship between the cleaning number (one reciprocation is counted as one) of the cleaning tool 51 and the discharge non-uniformity (corresponding to a variation in the charging property in the longitudinal direction of the charger 22) is investigated.

The performing conditions of the example 3 are the almost same as those of the example 1, and the same test as in the example 3 is performed using a comparative example 3 with the same configuration as the comparative example 1.

Figure 33:
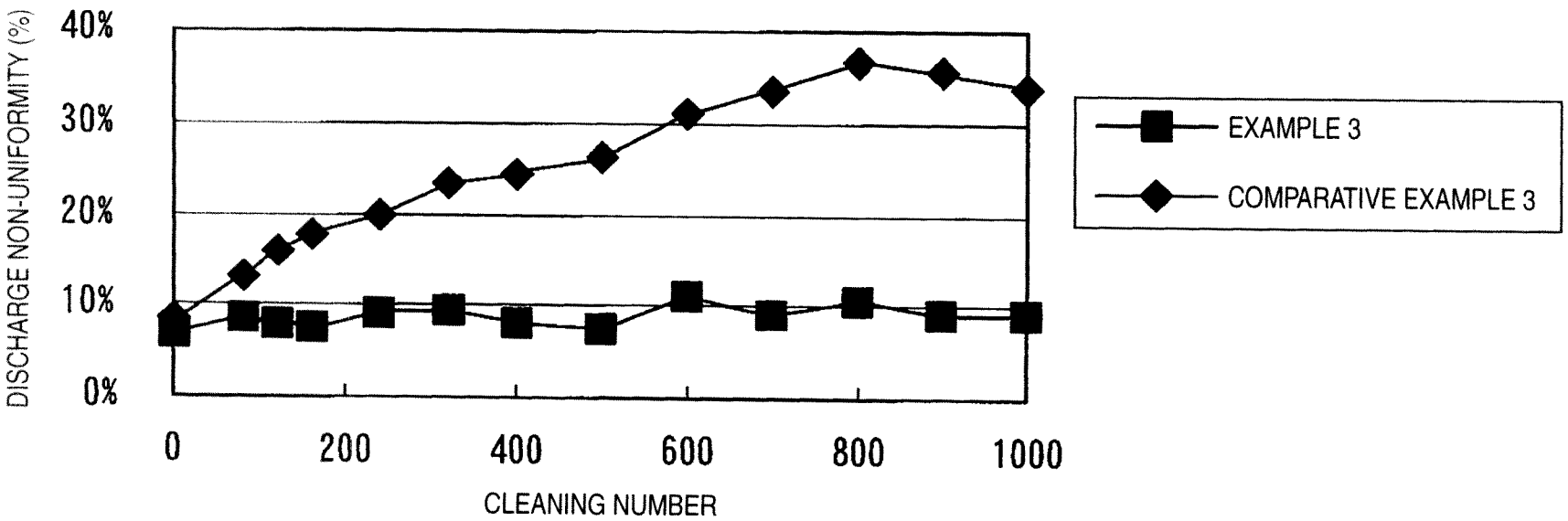
FIG. 33 is an explanatory view showing the relationship between the cleaning number and the discharge non-uniformity in an example 3 and a comparative example 3.

The results are shown in FIG. 33.

In FIG. 33, in the example 3, the discharge non-uniformity is suppressed to about 10% until the cleaning number reaches 1000 times, whereas in the comparative example 3, there is a tendency that the discharge non-uniformity immediately increased after the cleaning number is more than 100 times.

From a change tendency of FIG. 33, it may be found that the life of the cleaning tool 51 is about 9 to 10 times more excellent in the example 3 than the comparative example 3.

Example 4

Figure 34:
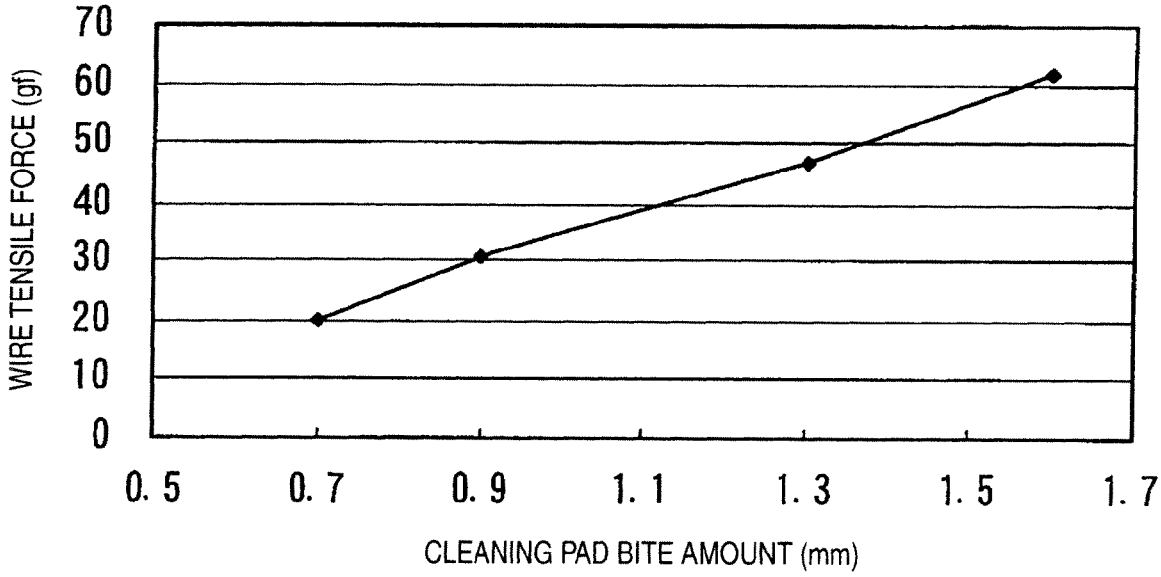
FIG. 34 is an explanatory view showing the relationship between the cleaning pad bite amount and the wire tensile force in a comparative example 4.

In a comparative example 4 (like the comparative example 1), the cleaning pad bite amount and the wire tensile force is investigated Whereby the results are obtained as shown in FIG. 34.

Figure 35:
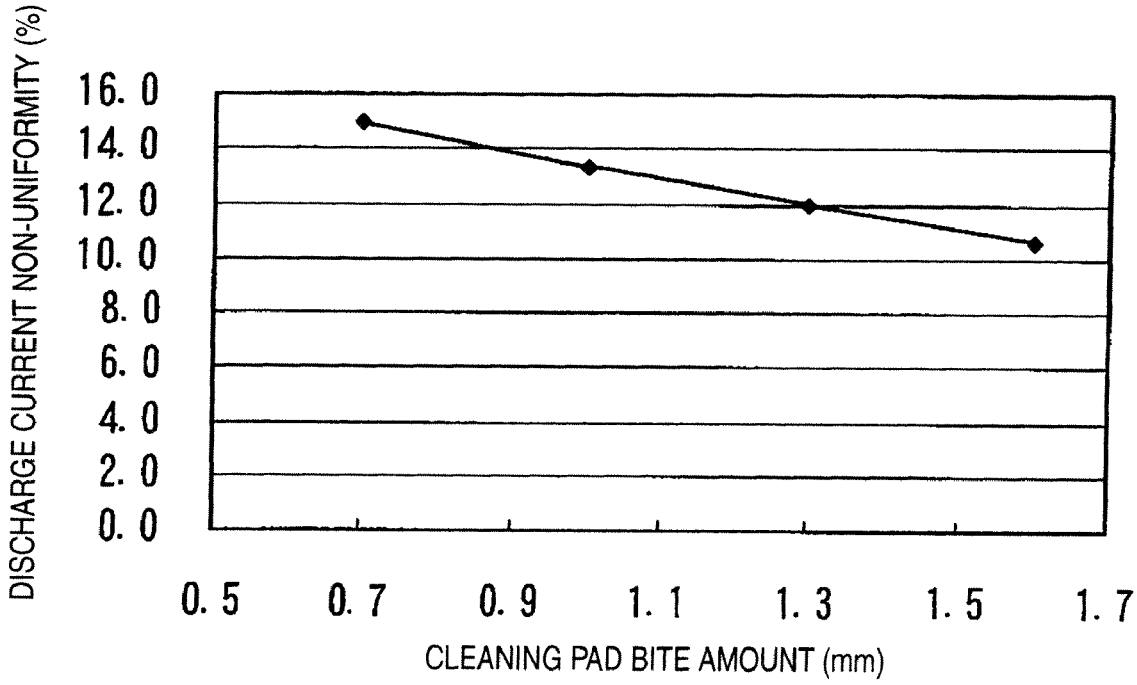
FIG. 35 is an explanatory view showing the relationship between the cleaning number bite amount and the discharge current non-uniformity in the comparative example 4.

Also, in the comparative example 4, the cleaning pad bite amount and the discharge current non-uniformity are investigated, whereby the results are obtained as shown in FIG. 35.

Figure 36:
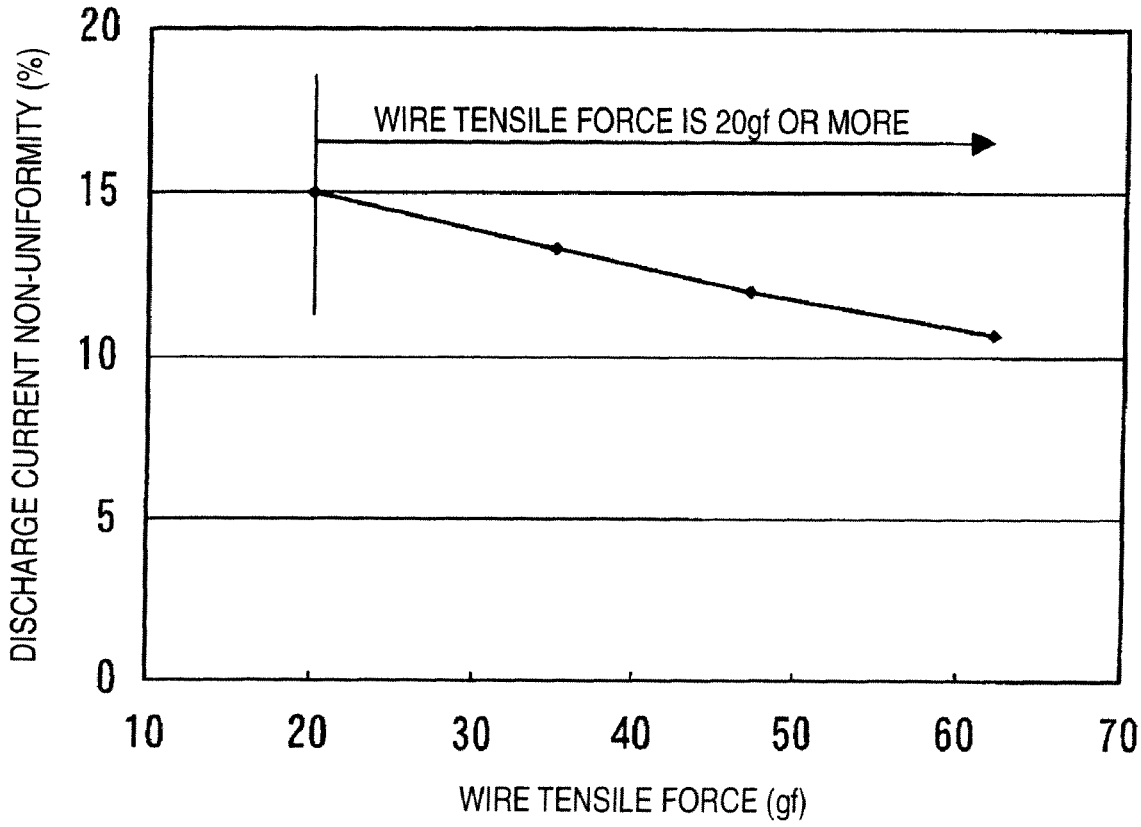
FIG. 36 is an explanatory view showing the relationship between the wire tensile force and the discharge current non-uniformity in the comparative example 4.

In the comparative example 4, the relationship between the wire tensile force and the discharge current non-uniformity is investigated based on FIGS. 34 and 35, whereby the results are obtained as shown FIG. 36.

From these results, it is required that the wire tensile force is 20 gf or more to suppress the discharge current non-uniformity to 15% or less in the comparative example 4.

Hence, in the example 4 (almost like the example 1), it is required that the wire tensile force of 20 gf or more is secured.

Example 5

In a comparative example 5 (almost like the comparative example 1), the cleaning pad bite amount is changed when the wire diameter of the discharge wire is 30 μm and 40 μm, and the cleaning number of the cleaning pad is checked to see whether or not the cleaning pad is cut, whereby the results are obtained as shown in FIG. 37.

In FIG. 37, in the comparative example 5, it may be found that in the case where the wire diameter is 40 μm, the cleaning pad is not cut until the cleaning number is about 720 times when the cleaning pad bite amount is 1.6 mm, but in the case where the wire diameter is as thin as 30 μm, the cleaning pad is cut at the cleaning number of about 90 times when the cleaning pad bite amount is 1.6 mm.

That is, in the comparative example 5, it may be understood that in the case where the wire diameter is 40 μm, the cleaning number could be maintained at 1000 times if the cleaning pad bite amount is 1.3 mm or less, but in the case where the wire diameter is 30 μm, the cleaning number could not be maintained at 1000 times or more unless the cleaning pad bite amount is 1.0 mm or less.

In this regard, in the example 5 (almost like the example 1), it is possible that the wire diameter of the discharge wire 42 is as thin as 30 μm, and the cleaning pad bite amount is set to 1.0 mm or less, whereby the cleaning ability with the cleaning tool 51 may be kept excellent in this form.

Example 6

An example 6 is the cleaning device 50 for the charger 22 for use in the exemplary embodiment 2. The relationship between the cleaning number (one reciprocation is counted as one) with the cleaning tool 51 and the streak grade (corresponding to the apparent state grade of bite scar formed on the cleaning pad of the cleaning device 50) is investigated.

The performing conditions of the example 6 are the almost same as those of the example 1, and the same test as in the example 6 is performed using a comparative example 6 with the same configuration as the comparative example 1.

Figure 38:
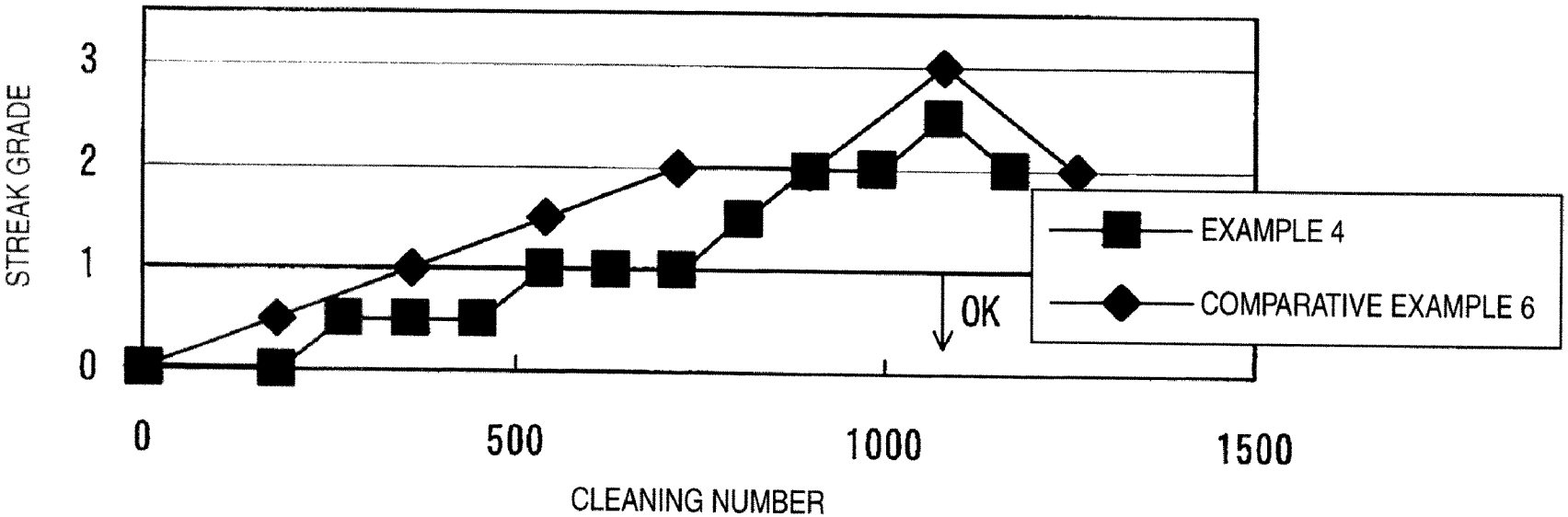
FIG. 38 is an explanatory view showing the relationship between the cleaning number and the streak grade in an example 6 and a comparative example 6.

The results are shown in FIG. 38. In FIG. 38, the streak grade is excellent (bite scar is less invisible) if it is 1 or less.

In FIG. 38, in the example 6, the streak grade is excellent or 10% until the cleaning number reached 700 times, but in the comparative example 6, there is a tendency that the streak grade is worse after the cleaning number is beyond 400 times.

From a change tendency of FIG. 38, it may be found that the life of the cleaning tool 51 is about 1.5 times more excellent in the example 6 than the comparative example 6.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a plurality of cleaning members including:

a pair of bilateral cleaning members arranged with an interval in a length direction of a wire rod;

an intermediate cleaning member located on an opposite side of the pair of bilateral cleaning members via the wire rod and arranged at an intermediate position between the bilateral cleaning members in the length direction of the wire rod;

a wire rod contact unit that controls at least one of the plurality of cleaning members so that the plurality of cleaning members contacts with or separates away from the wire rod; and a cleaning movement unit which moves the plurality of cleaning members along the length direction of the wire rod in the state where the plurality of cleaning members are in contact with the wire rod by the wire rod contact unit;

wherein A is a first interval along the length direction of the wire rod between the bilateral cleaning member located on a forward side of a movement direction and the intermediate cleaning member, B is a second interval along the length direction of the wire rod between the bilateral cleaning member located on the backward side in the movement direction and the intermediate cleaning member, and $A<B$ is satisfied when the pair of bilateral cleaning members and the intermediate cleaning member are moved with being into contact with the wire rod.

2. The cleaning device according to claim 1, further comprising:

a cleaning position adjustment unit that adjusts positions of the plurality of cleaning members so that A<B is satisfied when the pair of bilateral cleaning members and the intermediate cleaning member are moved with being into contact with the wire rod.

3. The cleaning device according to claim 2, wherein the cleaning movement unit is reciprocated along the length direction of the wire rod when the pair of bilateral cleaning members and the intermediate cleaning member are moved with being into contact with the wire rod by the wire rod contact unit.

4. The cleaning device according to claim 3, wherein the cleaning position adjustment unit changes an interval between adjacent cleaning members along the length direction of the wire rod in accordance with the movement direction of the plurality of cleaning members along the length direction of the wire rod.

5. The cleaning device according to claim 4, wherein the cleaning position adjustment unit changes the interval between the adjacent cleaning members along the length direction of the wire rod by moving the intermediate cleaning member along the length direction of the wire rod in accordance with the movement direction of the plurality of cleaning members along the length direction of the wire rod.

6. The cleaning device according to claim 4, wherein the cleaning position adjustment unit changes adjacent cleaning members along the length direction of the wire rod in a state where the plurality of cleaning members are separated away from the wire rod by the wire rod contact unit.

7. The cleaning device according to claim 5, wherein the wire rod contact unit having a swing member which swings the intermediate cleaning member around a swing fulcrum to contact or separate the intermediate cleaning member with or away from the wire rod, wherein the swing fulcrum is freely movable along the length direction of the wire rod, and wherein the cleaning position adjustment unit changes a relative position of the intermediate cleaning member with the bilateral cleaning members by changing a position of the swing fulcrum of the swing member 8. A charger comprising:

a charging housing opened opposed to a charged body;

a charging wire rod disposed within the charging housing; and the cleaning device according to claim 1 cleaning the charging wire rod.

9. An image forming assembly comprising:

an image carrier; and the charger according to claim 8 charging the image carrier, wherein an image forming apparatus is removable from a main body of the image forming assembly.

10. An image forming apparatus comprising:

an image carrier; and the charger according to claim 8 charging the image carrier.

11. The cleaning device according to claim 1, wherein each cleaning member includes an elastic base member.

12. The cleaning device according to claim 11, wherein each cleaning member includes a non-woven fabric on a cleaning surface side of the elastic base member.

13. The cleaning device according to claim 12, wherein each cleaning member includes a polishing material on a surface of the non-woven fabric.

* * * * *